US005629716A

United States Patent [19]

Okamoto et al.

[11] Patent Number: 5,629,716

[45] Date of Patent: May 13, 1997

[54] LUMINESCENT PANEL FOR COLOR VIDEO DISPLAY AND ITS DRIVING SYSTEM, AND A COLOR VIDEO DISPLAY APPARATUS UTILIZING THE SAME.

[75] Inventors: Takio Okamoto, Kusatsu; Kazunori Hirao, Yao; Toru Hirayama; Hajime Mae, both of Osaka; Takao Wakitani, Akashi; Yukiharu Ito, Takatsuki; Kouichi Nomura, Takatsuki; Seiji Matsubara, Takatsuki, all of Japan

[73] Assignee: Matsushita Electronics Corporation, Takatsuki, Japan

[21] Appl. No.: 274,808

[22] Filed: Jul. 14, 1994

[30] Foreign Application Priority Data

| | | | |
|---|---|---|---|
| Jul. 19, 1993 | [JP] | Japan | 5-177897 |
| Jul. 19, 1993 | [JP] | Japan | 5-177898 |
| Nov. 21, 1993 | [JP] | Japan | 5-282986 |
| Feb. 21, 1994 | [JP] | Japan | 6-022238 |
| Mar. 7, 1994 | [JP] | Japan | 6-035529 |

[51] Int. Cl.[6] ..... G09G 3/28

[52] U.S. Cl. ..... 345/60; 345/63; 345/68; 345/69; 345/70; 345/65; 345/72; 345/74; 345/75; 345/76; 313/485; 313/486; 313/487; 313/341; 313/302; 313/268; 315/169.3; 315/169.4

[58] Field of Search ..... 345/60, 63, 68, 345/69, 70, 65, 74, 72, 75, 76; 313/485–487, 341, 302, 268; 315/169.3, 169.4

[56] References Cited

U.S. PATENT DOCUMENTS

| | | | |
|---|---|---|---|
| 3,882,342 | 5/1975 | Kamegaya et al. | 313/188 |
| 4,423,355 | 12/1983 | Kageyama | 315/111.81 |
| 4,461,978 | 7/1984 | Mikoshiba et al. | 345/60 |
| 4,897,574 | 1/1990 | Saito et al. | 313/346 |
| 5,041,759 | 8/1991 | Kwon et al. | 313/495 |
| 5,508,092 | 4/1996 | Kimock et al. | 428/216 |
| 5,510,678 | 4/1996 | Sakai et al. | 315/58 |

FOREIGN PATENT DOCUMENTS

| | | |
|---|---|---|
| 0222928 | 5/1987 | European Pat. Off. . |
| 0372234 | 6/1990 | European Pat. Off. . |
| 2650425 | 2/1991 | France . |
| 53-119668 | 10/1978 | Japan . |
| 2-129847 | 5/1990 | Japan . |
| 3-39988 | 2/1991 | Japan . |

OTHER PUBLICATIONS

"High–Brightness Discharge Tube Large–Scale Color Video Display System" By K. Mochizuki et al.; published Aug., 1992, partial translation of National Technical Report, vol. 38, No. 4; pp. 78–84.

EPO Search Report (94111143.7) dated Dec. 5, 1994.

*Primary Examiner*—Richard Hjerpe
*Assistant Examiner*—Vui T. Tran
*Attorney, Agent, or Firm*—Ratner & Prestia

[57] ABSTRACT

A plurality of filaments are stretched in parallel on a rear plate, and an insulating plate is provided so as to cover the filaments. In the insulating plate, a plurality of through-holes are formed along the longitudinal direction of the respective filaments for exposing parts thereof. Each through-hole and phosphor layers, which are provided on the insulating layer adjacent to the through-hole, constitute one unit picture element. The respective phosphor layers in the respective picture element are installed in a plurality of cavities formed in a rib provided on a lower surface of the insulating plate, whereby separated from the neighboring phosphor layers. The respective cavities function as a discharge room, with a light-transmissive front plate, formed on the rib, as a lid and a portion of the insulating plate corresponding to the phosphor layer as a bottom. The respective discharge rooms overlap the through-hole at one end in the longitudinal direction thereof. A part of the filaments is exposed to the discharge room via the through-hole so as to act as a cathode. In addition, an anode exists respectively at the other end of the respective discharge rooms. In this manner, a luminescent panel for color video display, with a plurality of picture elements arranged in a matrix with a narrowed-pitch and a high density, is provided.

20 Claims, 21 Drawing Sheets

200

200

200

300

LUMINESCENT PANEL FOR COLOR VIDEO DISPLAY AND ITS DRIVING SYSTEM, AND A COLOR VIDEO DISPLAY APPARATUS UTILIZING THE SAME.

BACKGROUND OF THE INVENTION

1. Field of the Invention

The present-invention relates to a luminescent panel for color video display used as picture elements of a color video display apparatus, and its driving system. The invention also relates to a color video display apparatus utilizing the same.

2. Description of the Related Art

In a color video display apparatus capable of displaying an image on a large screen, many luminescent panels are arranged in two dimensions to form the large screen. Each luminescent panel corresponds to one or more picture elements. One type of the luminescent panel utilizes a fluorescent lamp capable of efficiently providing sufficient area brightness, which is disclosed in Japanese Laid-Open Patent Publication No. 2-129847, and its corresponding European Patent Application EP-A-0,372,234. Referring to FIG. 1, the structure of such a luminescent panel 100 will be described.

The luminescent panel 100 has a cylindrical container 2 housing a coil filament 1 serving as a cathode, a casket 4 in which six discharge rooms 3*a*–3*f* are partitioned, and a light-transmitting front plate 5. These constitute a hermetic container. Generally, the coil filament 1 is a tungsten electrode on which an oxide layer is formed. The oxide layer serves as an emitter which emits thermoelectrons by a current flow. Anodes 6*a*–6*f* are respectively provided in the discharge rooms 3*a*–3*f*, and mixed gas of mercury vapor and rare gas is confined therein as discharge gas.

A phosphor layer for emitting light (not shown) is provided on an inner wall of the casket 4. More specifically, for example, the phosphor layer in the discharge rooms 3*a* and 3*d* is for green light, the phosphor layer in the discharge rooms 3*b* and 3*e* is for red light, and the phosphor layer in the discharge rooms 3*c* and 3*f* is for blue light.

The luminescent panel 100 is a hot cathode type, and its specific mechanism for emitting light will be described hereinafter.

When an electric current flows through the coil filament 1, thermoelectrons are emitted from the oxide emitter formed on the surface of the coil filament 1. The thermoelectrons ignite discharge in the discharge rooms. The discharge excites the mercury vapor in the mixed gas confined in the discharge rooms 3*a*–3*f* so that ultraviolet light is generated. When the ultraviolet light irradiates the phosphor layer on the inner wall of the casket 4, light of a predetermined color is emitted.

By arranging the luminescent panels 100 in a matrix, a color video display apparatus displaying television images or the like can be constructed. In this case, one picture element is constituted by three discharge rooms 3*a*–3*c*, and another picture element is constituted by the other three discharge rooms 3*d*—3*f*. Therefore, one luminescent panel 100 corresponds to two picture elements.

Although the luminescent panel 100 of the hot cathode type requires a high voltage of approximately 300 V to ignite the discharge, the discharge is sustained by applying only a voltage of approximately 40 V thereafter. In addition, its luminous brightness is substantially in proportion to the value of a current emitted from the coil filament 1.

Other than the hot cathode type, a cold cathode type is also used as the luminescent panel for a color video display apparatus. According to the cold cathode type, the discharge gas is ionized by applying a high voltage between metal electrodes, thus the discharge occurs. Since the filament is not used in the luminescent panel of the cold cathode type, unlike in the luminescent panel of the hot cathode type, its size can be easily miniaturized. Thus, an array pitch of picture elements can be narrowed.

In the luminescent panel of the cold cathode type, however, it is necessary to always apply a high voltage of approximately 200 V to the discharge tube or to the current confining element in order to sustain the discharge. Therefore, energy efficiency is lower in the cold cathode type compared to in the hot cathode type because the cold cathode type requires a higher voltage so as to sustain the discharge. Especially in a large-sized color video display apparatus having a large screen, since the required number of luminescent panels increases as the screen size increases, improvement of energy efficiency is an important factor. Thus, the luminescent panel of the hot cathode type is an indispensable component in the video display apparatus which does not need a picture element pitch of the order of submillimeter.

However, the conventional luminescent panel 100 of hot electron type and the conventional color video display apparatus utilizing such a panel have the following problems.

The number of picture elements obtained by one luminescent panel 100 is limited to two according to the aforementioned structure. In addition, since the coil filament of a certain length is necessary, it is difficult to narrow the array pitch of the picture elements to approximately 10 mm to 30 mm or less by reducing the size of the luminescent panel 100. Therefore, when the number of picture elements is increased to improve resolution of a displayed images, the required number of the luminescent panels 100 is increased and the display screen becomes huge beyond necessity. Thus, external wirings of the luminescent panel 100 becomes complicated. In addition, due to such a huge display screen, it is difficult to apply it to a color video display apparatus to be used indoors.

Additionally, since six discharge rooms 3*a*–3*f* are arranged on the right and left sides around one coil filament 1, an amount of thermoelectrons supplied to each of the discharge rooms 3*a*–3*f* is not likely to be uniform. As a result, a voltage for sustaining the discharge in each of the discharge rooms 3*a*–3*f* varies, and brightness is not likely to become uniform. In order to solve the above problems, it is thought to provide a plurality of coil filaments 1 in the cylindrical container 2 in one luminescent panel 100. In this case, however, the total amount of heat released during operation increases, so that the temperature is likely to be increased beyond the optimum operation temperature of the luminescent panel 100. Consequently, the luminous brightness is reduced, while the likelihood of damage to the luminescent panel 100 is increased.

In order to solve the above-mentioned problems regarding the conventional luminescent panel of the hot cathode type, it is necessary to provide a new hot cathode type luminescent panel.

SUMMARY OF THE INVENTION

The luminescent panel for color video display of this invention comprises: a rear plate on which a plurality of filaments are stretched in a row direction; an insulating plate provided on the rear plate so as to cover the plurality of filaments, the insulating plate having a plurality of through-holes arranged in a matrix for exposing respective predetermined portions of the plurality of filaments; a light-transmissive front plate including a plurality of anode lines stretched in a column direction and a rib covering the plurality of anode lines, the rib comprising a plurality of cavities arranged in a matrix for igniting hot cathode discharge between a selected one of the plurality of filaments and a selected one of the plurality of anode lines via a corresponding one of the plurality of through-holes; a first phosphor means for being excited by the discharge and emitting a first kind of phosphorescence, the first phosphor means provided corresponding to a first line group of the plurality of the anode lines; and a second phosphor means for being excited by the discharge and emitting a second kind of phosphorescence, the second phosphor means provided corresponding to a second line group of the plurality of the anode lines.

The luminescent panel may further comprise a third phosphor means for being excited by the discharge and emitting a third kind of phosphorescence, the third phosphor means provided corresponding to a third line group of the plurality of the anode lines.

In one embodiment of the invention, each of the plurality of through-holes is further divided corresponding to kinds of the phosphor means.

In another embodiment of the invention, the luminescent panel further comprises an outer peripheral wall provided along the outer periphery of the luminescent panel.

In still another embodiment of the invention, respective terminals fixing each of the plurality of filaments are extended onto a side surface of the rear plate, and each of the plurality of anode lines is extended to a side surface of the front plate.

In still another embodiment of the invention, a mixture gas of mercury vapor and a rare gas is confined in the plurality of cavities with a gas pressure in a range of 2 to 20 Torr, the rare gas being selected from a group consisting of Xe gas and Kr gas.

In still another embodiment of the invention, each of the plurality of filaments includes a tungsten wire as a core member and an oxide layer provided around the core member, the oxide layer capable of emitting electrons. Rhenium may be further added to the tungsten wire.

In still another embodiment of the invention, the oxide layer includes a main element selected from a group consisting of barium oxide, strontium oxide and calcium oxide. The oxide layer may further include an additive at a concentration of 2 to 10 wt %, the additive being selected from a group consisting of zirconium and zirconium oxide.

In still another embodiment of the invention, the luminescent panel further comprises a driving system for driving the luminescent panel, the driving system comprising: a plurality of transformers respectively having at least one secondary winding, the at least one secondary winding respectively connected to each of the plurality of filaments; a plurality of transistors respectively connected to the at least one secondary winding of each of the plurality of transformers; a scanning circuit for selectively and sequentially switching the plurality of transistors so as to selectively and sequentially scan the plurality of filaments; a plurality of constant current circuits respectively connected to each of the plurality of anode lines via each of a plurality of first diodes; a PWM circuit for allowing a discharge current to flow during a horizontal scanning period through each of the plurality of anode lines via a corresponding one of the plurality of constant current circuits and a corresponding one of the plurality of first diodes, the discharge current having a pulse width determined in accordance with a video brightness signal; and a high voltage supplying means for supplying a high voltage pulse to the plurality of anode lines so as to ignite the discharge.

In still another embodiment of the invention, the high voltage supplying means is a power supply capable of a high voltage.

Alternatively, the high voltage supplying means comprises: a boosting circuit; a plurality of condensers, one terminal thereof respectively connected to each of the plurality of anode lines, the other terminal of the condensers respectively connected to the boosting circuit; and a plurality of gate circuits for compulsorily maintaining the plurality of constant current circuit in an ON state and supplying a charging current to the plurality of condensers during a horizontal blanking period, wherein the boosting circuit outputs a first predetermined voltage at an initial stage of the horizontal blanking period so as to charge the plurality of condensers up to a discharge sustaining voltage, and then outputs a second predetermined voltage so as to ignite the discharge between the selected one of the plurality of filaments and the selected one of the plurality of anode lines at an initial stage of the horizontal scanning period.

In still another embodiment of the invention, each of the plurality of transistors is respectively connected to a center tap provided in the at least one secondary winding of each of the plurality of transformers.

Alternatively, the luminescent panel further comprises: a plurality of second diodes, a positive terminal thereof being connected to one end of the at least one secondary winding of each of the plurality of transformers; and a plurality of third diodes, a positive terminal thereof connected to the other end of the at least one secondary winding of each of the plurality of transformers, a negative terminal of the respective third diodes connected to a negative terminal of the respective second diodes, wherein each of the plurality of transistors is connected to each connecting point between the respective second diodes and the respective third diodes. The luminescent panel may further comprise a plurality of resistors for supplying a bias voltage, the resistors respectively connected to one end of the at least one secondary winding of each of the plurality of transformers.

In still another embodiment of the invention, a plurality of the luminescent panels are arranged in a matrix so as to form a display, further connected to the display are: a plurality of the driving systems corresponding to each of the plurality of luminescent panels, and control means for distributing a signal of an image to be displayed on the display to the plurality of luminescent panels and driving the plurality of driving systems in accordance with the signal.

Thus, the invention described herein makes possible the advantages of providing (1) a high performance luminescent panel for color video display with high energy efficiency of a hot cathode type light-emitting device, having narrow-pitched high density picture elements arranged in a matrix and simplified external wirings, capable of being used both for indoor and outdoor color video display apparatuses, (2) a driving system for the luminescent panel, and (3) a color video display apparatus utilizing a plurality of the luminescent panels and driving systems.

These and other advantages of the present invention will become apparent to those skilled in the art upon reading and understanding the following detailed description with reference to the accompanying figures.

DESCRIPTION OF THE PREFERRED EMBODIMENTS

The present invention will be described by way of examples with reference to the drawings.

EXAMPLE 1

Figure 2:
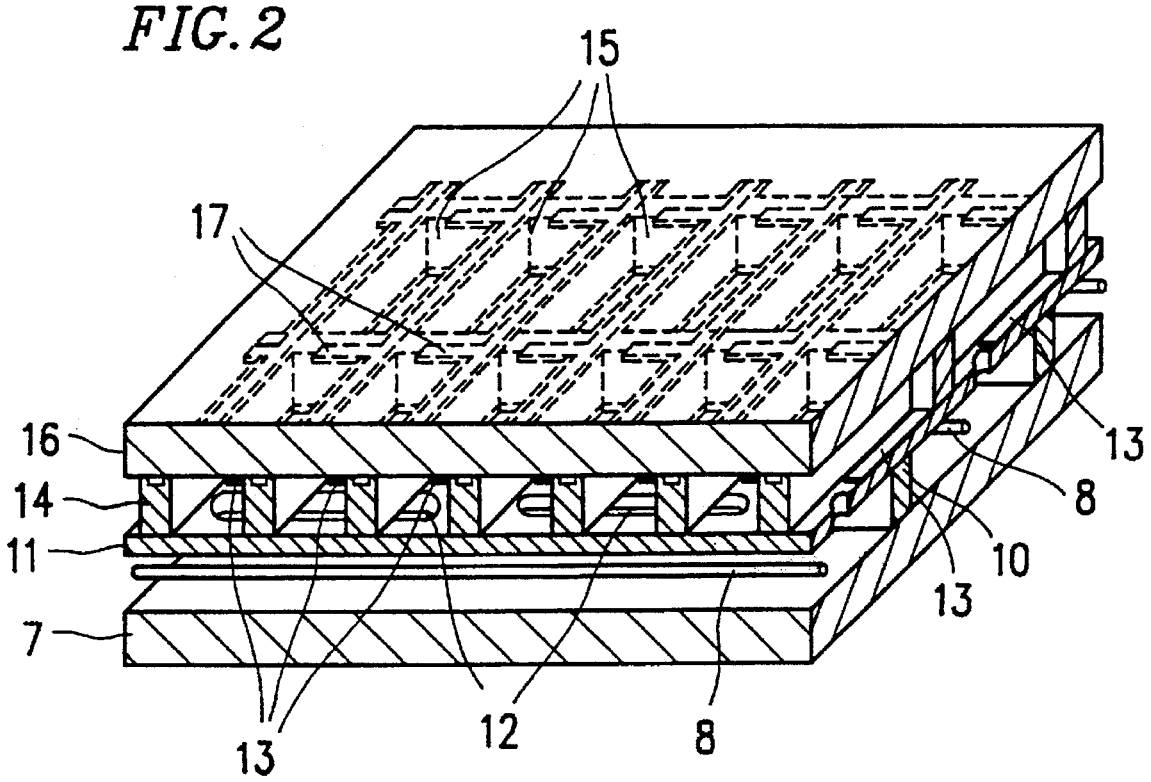
FIG. 2 is a perspective view schematically illustrating an overall structure of a luminescent panel in accordance with a first example of the present invention.

FIG. 2 is a perspective view showing an overall structure of a luminescent panel according to a first example of the present invention. The luminescent panel 200 is basically constituted by a rear plate 7, a front plate 16 and an insulating plate 11 sandwiched by the rear and front plates 7 and 16. There is formed a hermetic container sealed by glass having a low softening temperature (not shown) provided around the periphery of the rear plate 7, the insulating plate 11 and the front plate 16. In the hermetic container, a mixed gas of mercury vapor and rare gas serving as discharge gas is confined. In addition, in the thus structured hermetic container, several kinds of elements are provided, which will be described hereinafter referring to FIG. 3.

Figure 3:
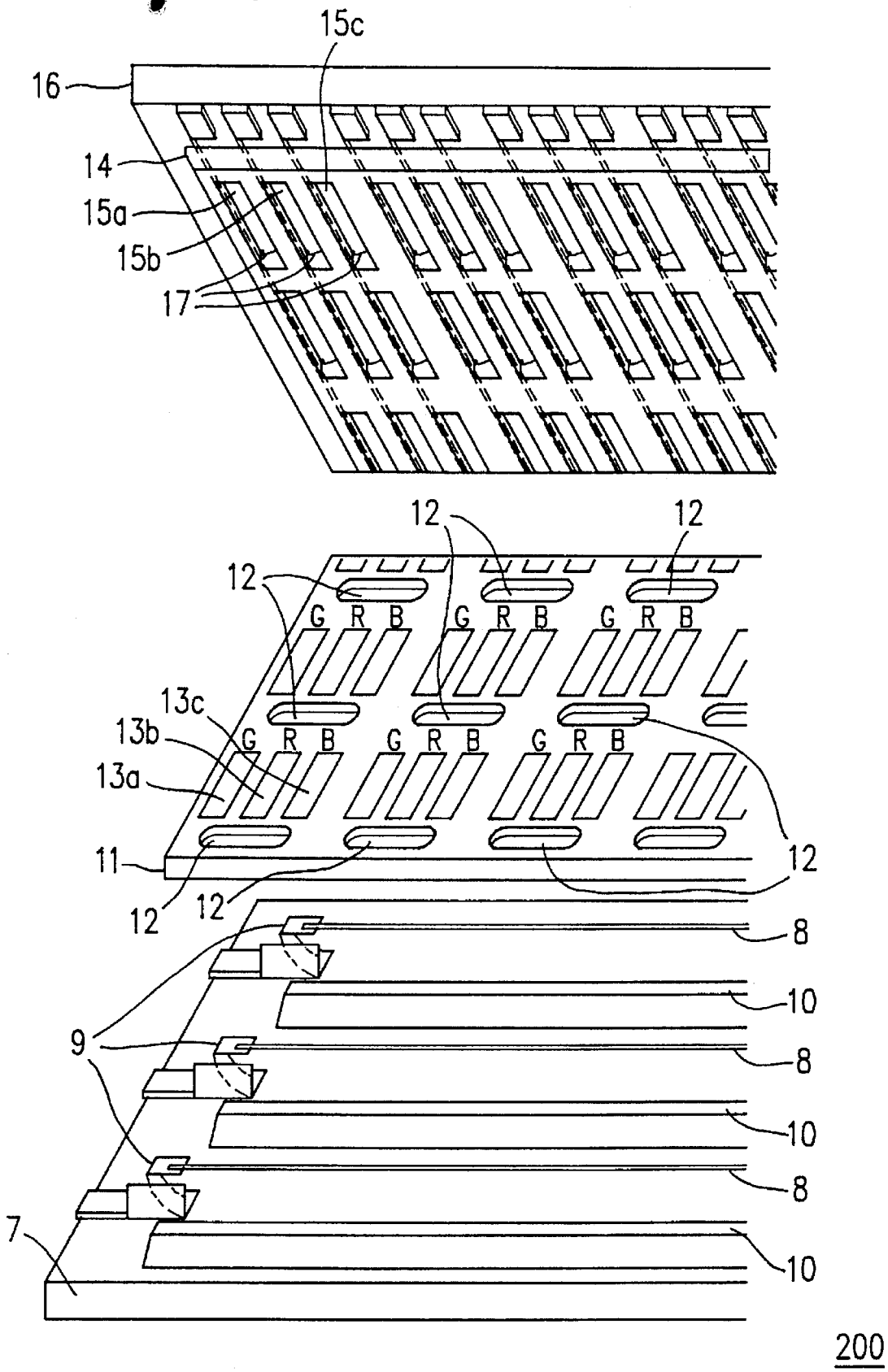
FIG. 3 is a partial perspective view illustrating detailed structures of each portion of the luminescent panel in FIG. 2.

FIG. 3 is a partial perspective view showing the structure of the luminescent panel 200 in further detail.

A plurality of filaments 8 are fixed and stretched in several rows by using terminals 9 on the rear plate 7, formed of glass or ceramics. Preferably, terminals on at least one end of the respective filaments 8 have spring properties, which can be formed of a material such as a cobalt-nickel-chromium alloy. The respective filaments 8 have an oxide layer having an electron emitting characteristic (referred to as an emitter hereinafter) formed on a core member formed of a tungsten wire or a tungsten wire containing rhenium. The main elements of the emitter are barium oxide and strontium oxide. When a current flows through the filaments 8, the filaments 8 are heated up to approximately 800° C. or more, whereby thermoelectrons are emitted from the emitter. The emitter may further contain calcium oxide as an additional main element.

A ridge 10 is respectively provided between the adjacent filaments 8, which separates a space around one filament 8 from a space around the adjacent filament 8.

The insulating plate 11 is put on the rear plate 7 so as to cover the ridges 10 and the filaments 8. In the insulating plate 11, a plurality of through-holes 12 for exposing parts of the respective filaments 8 are provided along the longitudinal direction of the respective filaments 8. The insulating plate 11 may be formed of, for example, glass or ceramics.

On the surface of the insulating plate 11, phosphor layers **13*a*–13*c* formed of three kinds of rare earth phosphor materials, which respectively emit red, green and blue light, are provided adjacent to the through-holes 12. One through-hole 12 and three phosphor layers 13*a*–13*c*** form a unit picture element.

The light-transmitting front plate 16 formed of glass is laminated onto the insulating plate 11. A rib 14 is laminated on the surface of the front plate 16 on the side opposing the insulating plate 11 (referred to as a lower surface hereinafter). In the rib 14, oval cavities **15*a*–15*c* are formed at positions corresponding to the respective phosphor layers 13*a*–13*c* on the insulating plate 11. The phosphor layers 13*a*–13*c* in the picture element are installed in the cavities 15*a*–15*c* respectively and separated from the phosphor layers in the adjacent picture element. The cavities 15*a*–15*c* may be square. The respective cavities 15*a*–15*c* function as the discharge room with the front plate 16 and the insulating plate 11** as a lid and a bottom, respectively.

Each of the cavities **15*a*–15*c* is provided so as to overlap with the through-holes 12 at one end thereof in the longitudinal direction. Thus, the part of the filament 8 is respectively exposed to the respective discharge rooms through the respective through-holes 12 and can serve as the cathodes. Meanwhile, anodes 17 are provided on the lower surface of the front plate 16 so as to be positioned at the other end of the respective cavities 15***a*–15*c*. A lead line of the respective anodes 17 is extended to one end of the front plate 16 through a contacting portion between the rib 14 and the front plate 16.

Figure 4:
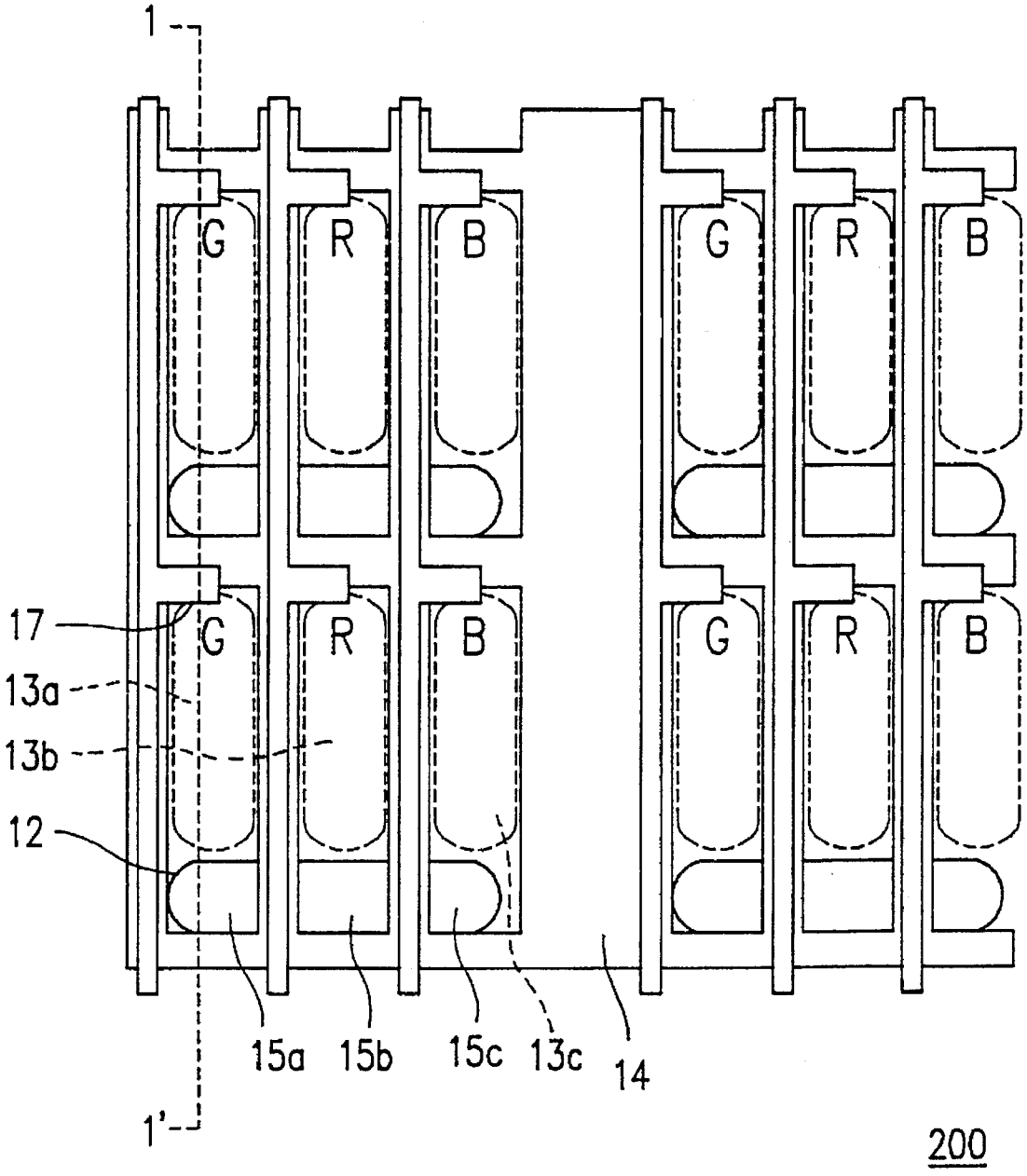
FIG. 4 is a partial plain view illustrating positional relations among the structures of each portion of the luminescent panel in FIG. 2.
Figure 5:
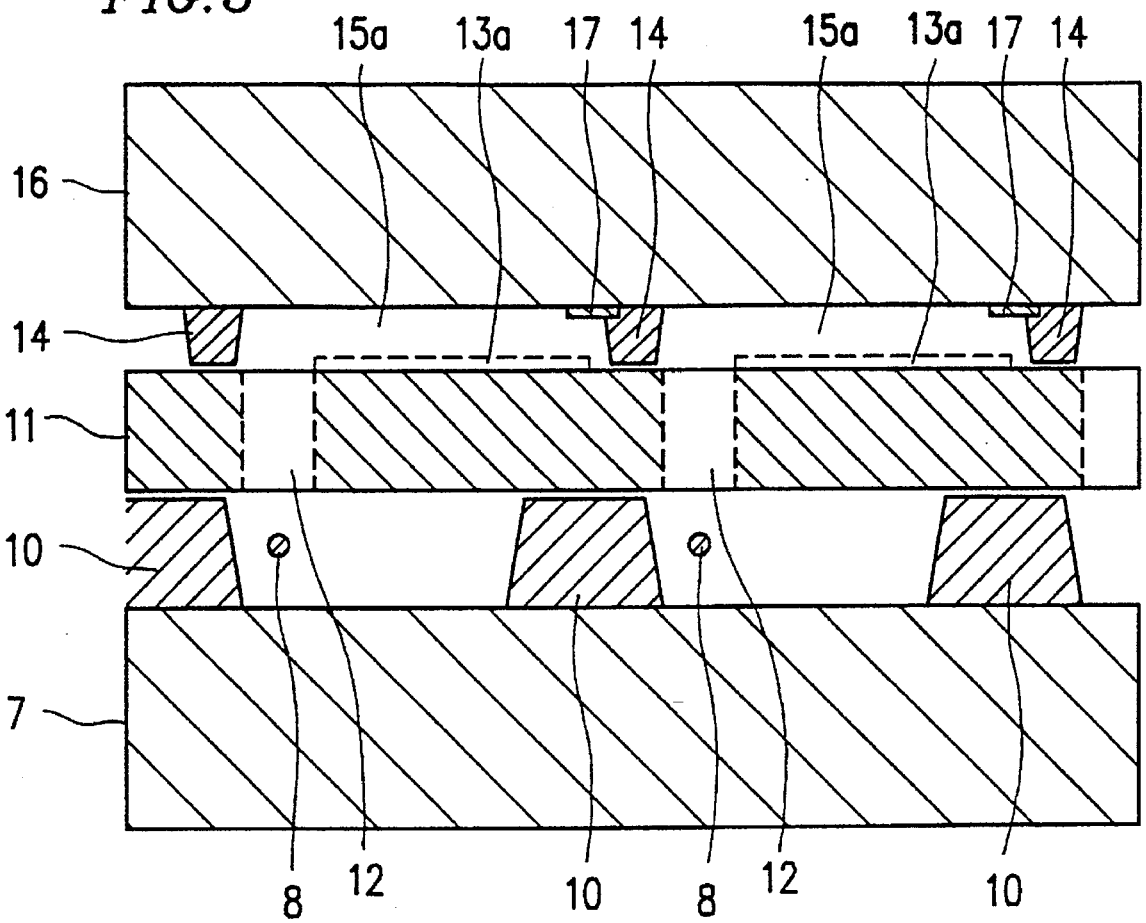
FIG. 5 is a sectional view taken along a 1–1' line indicated in FIG. 4.

FIG. 4 is a partial plain view taken from the upper surface of the front plate 16 toward the insulating plate 11, which shows positional relations among portions in the luminescent panel 200 having the above-mentioned structure according to this example. Additionally, FIG. 5 is a sectional view taken along a line 1–1' of FIG. 4.

The structure will be described referring to FIG. 5. As described above, a part of the respective filaments 8 in the longitudinal direction is exposed to the cavity 15*a*, that is, the discharge room via the through-hole 12 provided in the insulating plate 11 and thus functions as the cathode. On the bottom of the cavity 15*a*, the phosphor layer 13*a* which emits, for example, red light is provided. In addition, the anode 17 is provided at another end of the cavity 15*a* opposite to the through-hole 12. The discharge rooms formed by the cavities 15*b* and 15*c* adjacent to the cavity 15*a* have the same structure.

Thus, in the respective discharge rooms, the cathode which is a part of the filaments 8, the independent anode 17 and one of the phosphor layers 13*a*–13*c* respectively for emitting one of green, red or blue light are provided. A plurality of picture elements, each constituted by the three discharge rooms, are formed.

The phosphor layers 13*a*–13*c* may be provided not only on the surface of the insulating plate 11, but also over an inner surface of the respective discharge rooms. In addition, although one through-hole 12 is provided for a set of the three discharge rooms (three cavities 15*a*–15*c*) forming one picture element in the above description of this example of the invention, one through-hole may be provided for each of the discharge rooms (the cavities 15*a*–15*c*). Furthermore, although three discharge rooms are provided for each picture element in order to enable full-colored video display in the above explanation, only two discharge rooms may be provided for each picture element, if the full-colored video display is not necessary.

As shown in FIG. 5, the through-hole 12 is provided just above the filament 8. However, that positional relation does not have to be strict. Even when the through-hole 12 does not exist Just above the filament 8, the above-described advantages can be also obtained.

The ridges 10 formed on the surface of the rear plate 7, the anodes 17 formed on the lower surface of the front plate 16 and their lead lines can be formed by printing thick films of a material such as nickel. The rib 14 can be formed of glass. Since fine processing is possible in such a thick film printing, the array pitch of the cavities 15*a*–15*c*, that is, the discharge rooms can be narrowed to approximately 2–3 mm. As a result, the array pitch of the picture elements can be below 10 mm and thus can be arranged with high density such as a 100×100 matrix within an approximately 30 cm square.

A typical external size of the luminescent panel 200 of this example of the invention is 230 mm×120 mm. In addition, a picture element array pitch is 7.0 mm, the number of picture elements is 32×16, the number of the filaments 8 is 16, the number of the anodes 17 is 32×3, and a pitch of lead lines for the anodes 17 is 2.33 mm.

In the thus formed luminescent panel 200 for color video display, the filaments 8 emit thermoelectrons by allowing a current to flow into the filaments 8 by a divided time. Therefore, the cathode is driven by the divided time. More specifically, a voltage required to ignite the discharge is selectively applied between the filaments 8 and the anodes 17, and a discharge sustaining time in the selected discharge room is changed according to a video signal. Thus, color images can be displayed. A driving system will be described in detail later.

Furthermore, a frame-shaped thin outer peripheral wall may be provided along the outer periphery of the hermetic container formed by the rear plate 7, the insulating plate 11 and the front plate 16 so as to improve the airtightness of the hermetic container. Such a wall will be described later with reference to a second example of the invention.

According to the luminescent panel 200 of this example of the invention, each filament 8 functions as the cathode at a plurality of positions in the longitudinal direction, whereby one cathode exists in each of the discharge rooms. Therefore, the amount of the thermoelectrons supplied or the discharge sustaining voltage in each of the discharge rooms does not vary, whereby uneven brightness is prevented.

Furthermore, since the cathodes for many discharge rooms are formed with one filament 8, as well as a matrix arrangement is implemented in which the filaments 8 are arranged in a plurality of rows and the anodes 17 are arranged in a plurality of columns, the external driving wirings can be simplified. In addition, since many discharge rooms can be arranged in high density with a narrow pitch, using the luminescent panels of this example of the invention can provide not only the large-sized color video display apparatus for outdoors which forms a large screen using many luminescent panels, but also the color video display apparatus of high resolution with the small number of luminescent panels.

EXAMPLE 2

Figure 6:
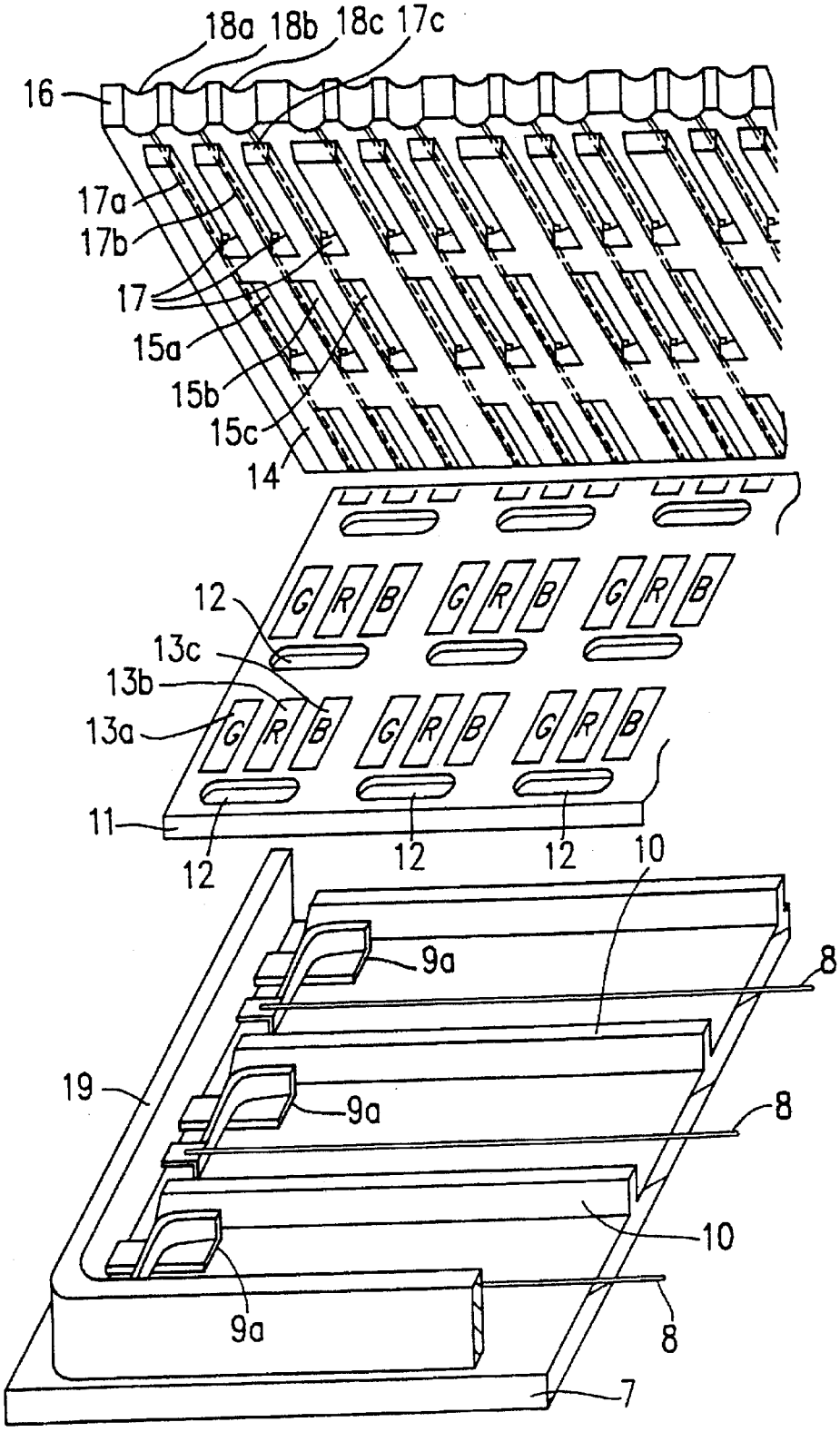
FIG. 6 is a partial perspective view illustrating a structure of a luminescent panel in accordance with a second example of the present invention.

A luminescent panel according to a second example of the invention will be described. FIG. 6 is a partial perspective view showing the luminescent panel 300 according to the second example of the invention. The luminescent panel 300 has basically the same structure of the luminescent panel 200 in the first example of the invention which was described referring to FIGS. 2–5. In the luminescent panel 300 shown in FIG. 6, the same reference numerals are used for elements which are identical to the luminescent panel 200 and their descriptions will be omitted here.

The luminescent panel 300 differs from the luminescent panel 200 in that terminals supporting the filaments 8 and lead lines of the anodes 17 are extended from the sides of the rear plate 7 and the front plate 16 toward the outside in order to further simplify the external driving wirings. Another difference between the two luminescent panels 200 and 300 is that a frame-shaped thin outer peripheral wall 19 is provided in order to improve the airtightness of the hermetic container formed by the rear plate 7, the insulating plate 11 and the front plate 16.

A basic structure of a picture element of the luminescent panel 300 is the same as that of the luminescent panel 200. Parts of the respective filaments 8 are exposed via the through-hole 12 to the discharge rooms formed by the cavities 15*a*–15*c* in the rib 14, the front plate 16 and the insulating plate 11, so as to serve as the cathodes. In addition, the anodes 17 are provided in each of the discharge rooms. The phosphor layers 13*a*–13*c*, which emit red, green and blue light respectively, are provided on the insulating plate 11 corresponding to the bottom of the respective cavities 15*a*–15*c*.

Figure 7:
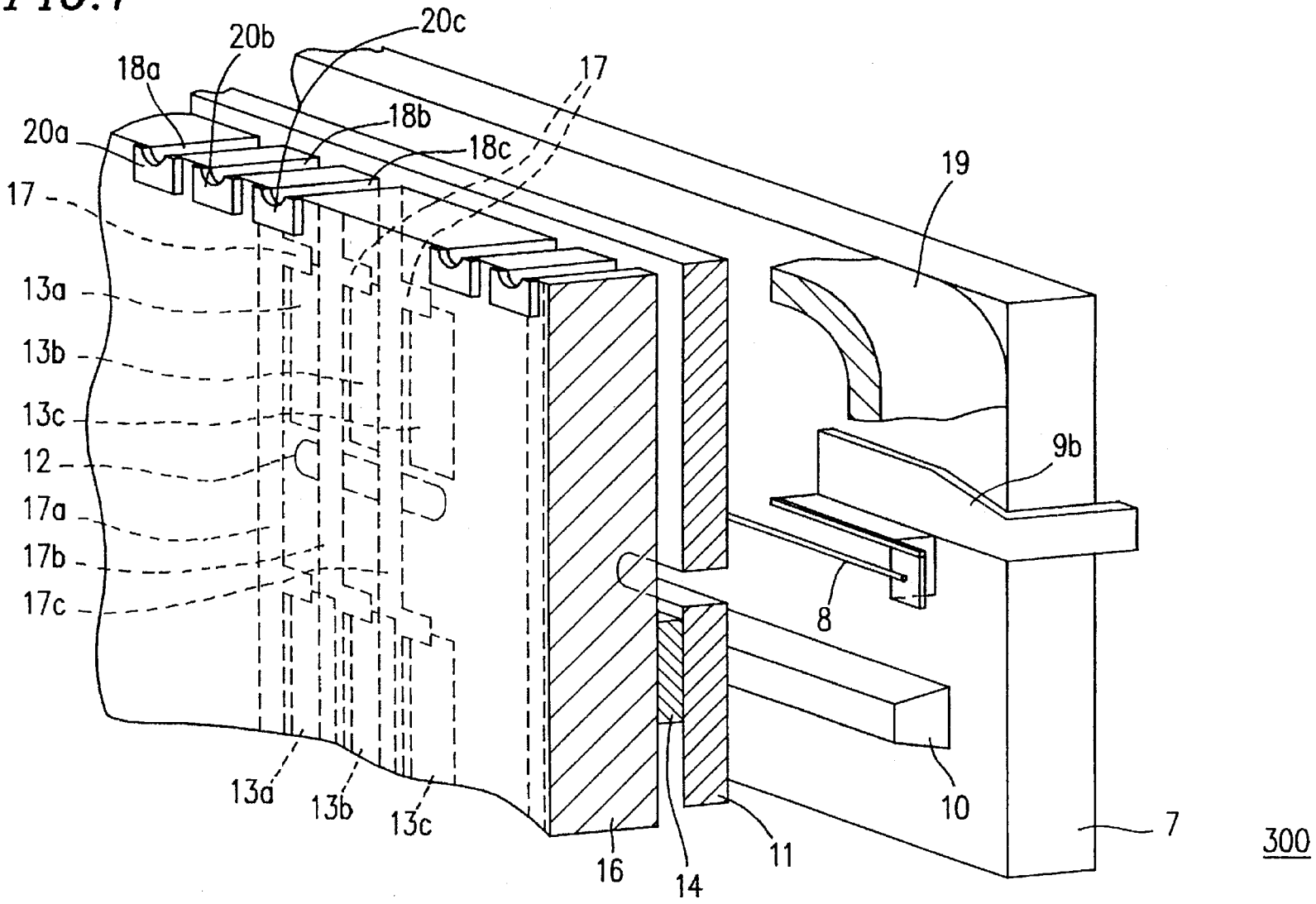
FIG. 7 is another perspective view of the luminescent panel in FIG. 6.

FIG. 7 is a partial perspective view showing the luminescent panel 300 according to this example of the invention. In order to make the figure clearer, the outer peripheral wall 19 is drawn only at a corner in the figure. In the luminescent panel 300 in this example of the invention, the lead lines 17*a*–17*c* for collecting the anodes 17 existing in the respective discharge rooms in column units are wired so as to reach one end of the front plate 16 through the contacting portion between the rib 14 and the front plate 16. The lead lines 17*a*–17*c* are further connected to lead ditches 18*a*–18*c* formed on the side surface of the front plate 16. The lead lines 17*a*–17*c* may be further extended from the lead ditches 18*a*–18*c* to an upper surface of the front plate 16 to be pads 20*a*–20*c* for connecting the external wirings thereto, which facilitates the wiring process.

The lead ditches 18*a*–18*c* can be formed by the following method. A glass plate of size corresponding to two front plates is prepared, and many small through-holes are formed on a line crossing the center of the plate with a predetermined pitch. Then, after conducting paste is poured into the small through-holes and baked, the glass plate is divided into two on the above-mentioned line, whereby two front plates 16 are simultaneously formed. Alternatively, before a thick film printing of the lead lines 17*a*–17*c* is conducted on the front plate 16, chamfering is performed on an edge portion extending from the lower surface to the side surface or from the side surface to the upper surface of the front plate 16. Then, the conducting paste may be poured from the chamfered edge portion onto the side surface using its viscosity in the above-described thick film printing process. In another case, the conducting paste may be printed with a roller used in an offset printing method, whereby the lead ditches 18*a*–18*c* are formed.

To the thus formed lead ditches 18*a*–18*c* attached is a flexible lead substrate with a thickness of approximately 30 μm having a base material of polyimide film or the like. Thus, the external anode driving wirings are connected through conducting leads of the substrate.

Meanwhile, in order to simplify the external cathode wirings in the luminescent panel 300, a configuration of the terminals at both ends of the filaments 8 has been improved. In FIG. 7, a fixed terminal 9*b* provided at one end of the filaments 8 is shown. According to this example of the invention, an external edge of the fixed terminal 9*b* is extended to the side surface of the rear plate 7 through a lower portion of the outer peripheral wall 19 (not shown). A terminal 9*a* having spring properties as shown in FIG. 6 is provided at the other end of the filaments 8, and the terminal 9*a* is also extended to the side surface of the rear plate 7 through the lower portion of the outer peripheral wall 19, similarly to the fixed terminal 9*b*.

According to the above-mentioned structure, the external wirings connected to the filaments 8 serving as the cathodes and to the anodes 17 can be easily performed.

Figure 8:
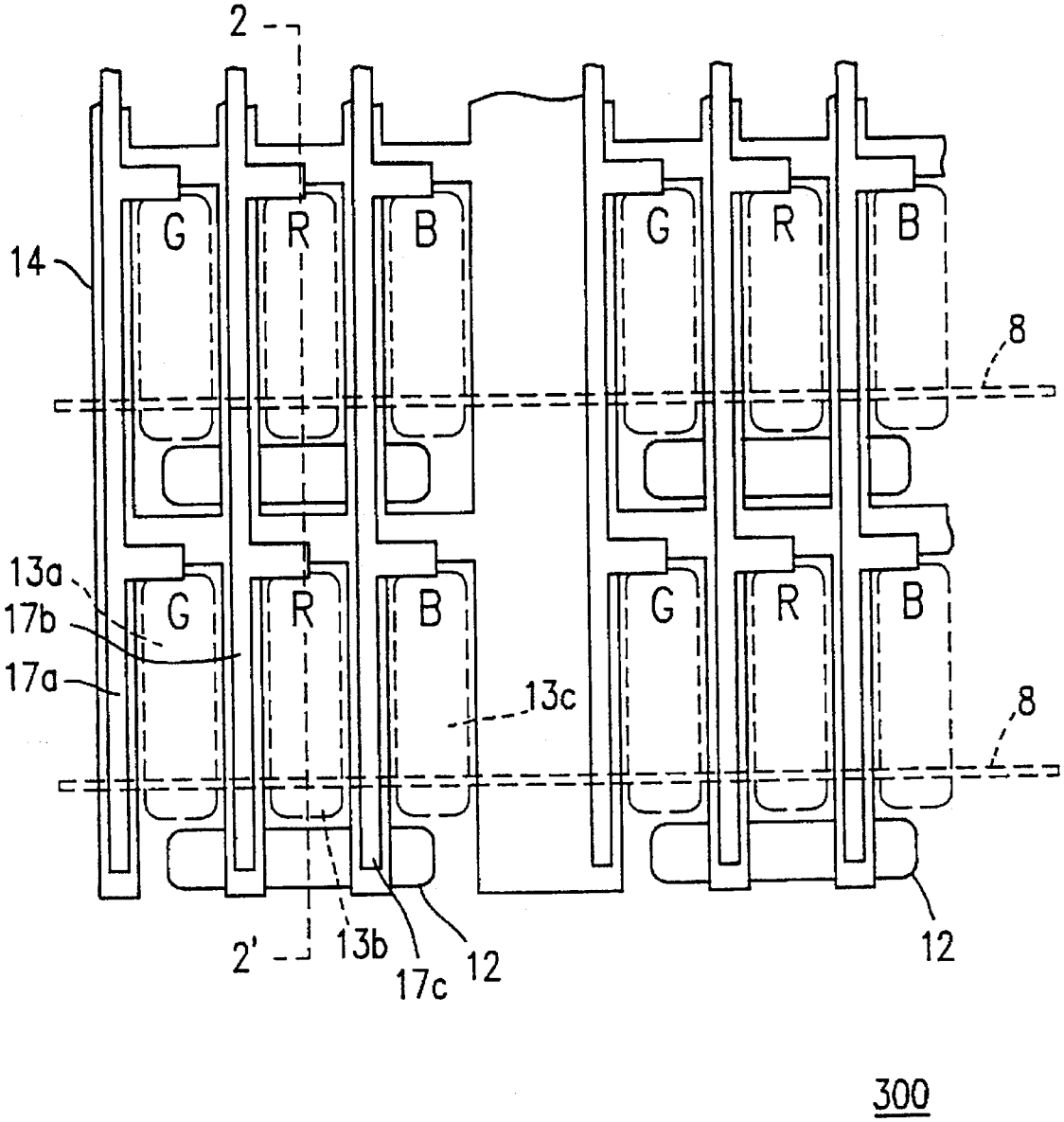
FIG. 8 is a partial plain view illustrating positional relations among the structures of each portion of the luminescent panel in FIG. 6.
Figure 9:
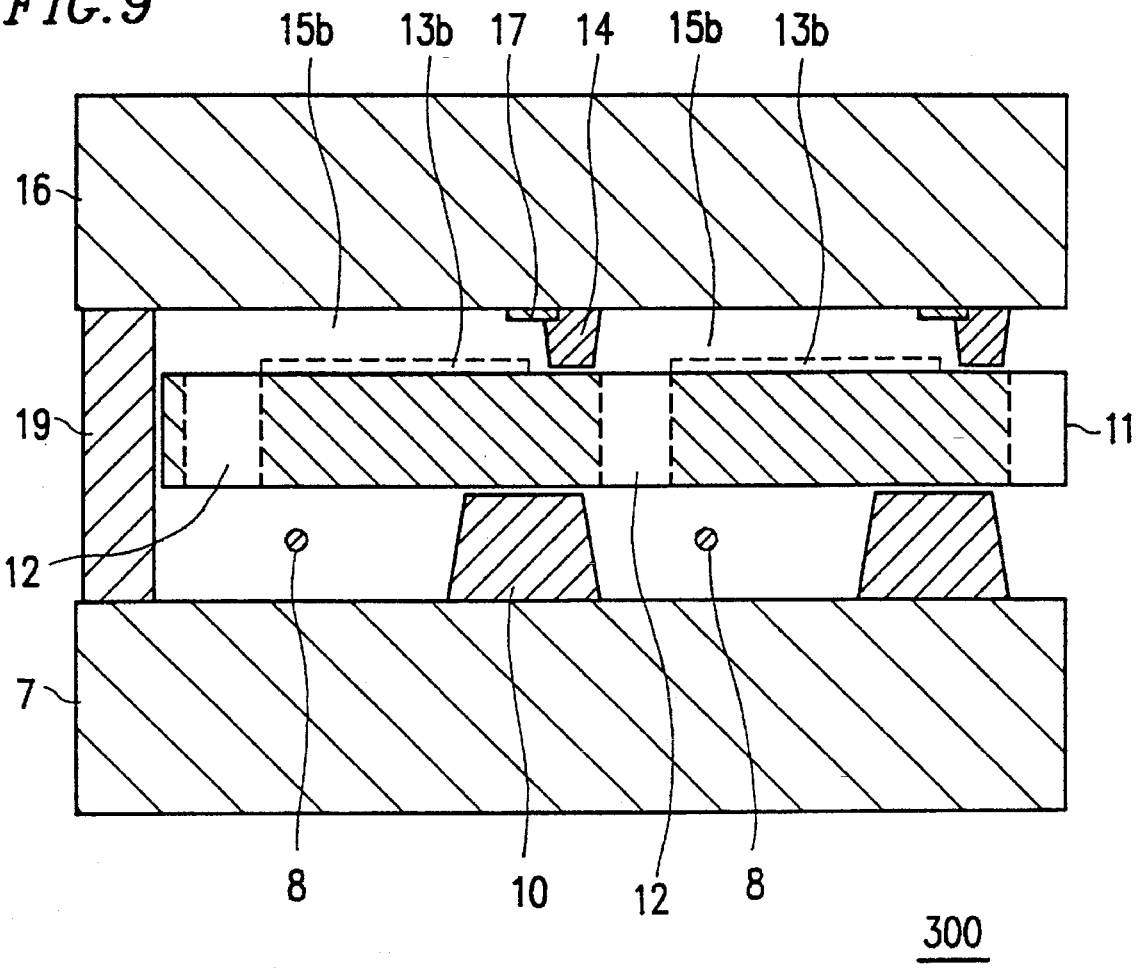
FIG. 9 is a sectional view taken along a 2–2' line indicated in FIG. 8.

FIG. 8 is a partial plan view showing the positional relations among portions, which is taken from the upper surface of the front plate 16 toward the insulating plate 11 in the luminescent panel 300 of this example of the invention having the above-described structure. In addition, FIG. 9 is a sectional view taken along a line 2–2' of FIG. 8.

As described above, according to this example of the invention, in order to improve the airtightness of the hermetic container of the luminescent panel 300 formed by the rear plate 7, the insulating plate 11 and the front plate 16, the outer peripheral wall 19 is provided at the outer periphery. As shown in FIG. 9, the outer peripheral wall 19 is sandwiched between the rear plate 7 and the front plate 16 and serves as a side wall of the hermetic container. A remaining gap is sealed by glass having a low softening temperature.

Figure 10:
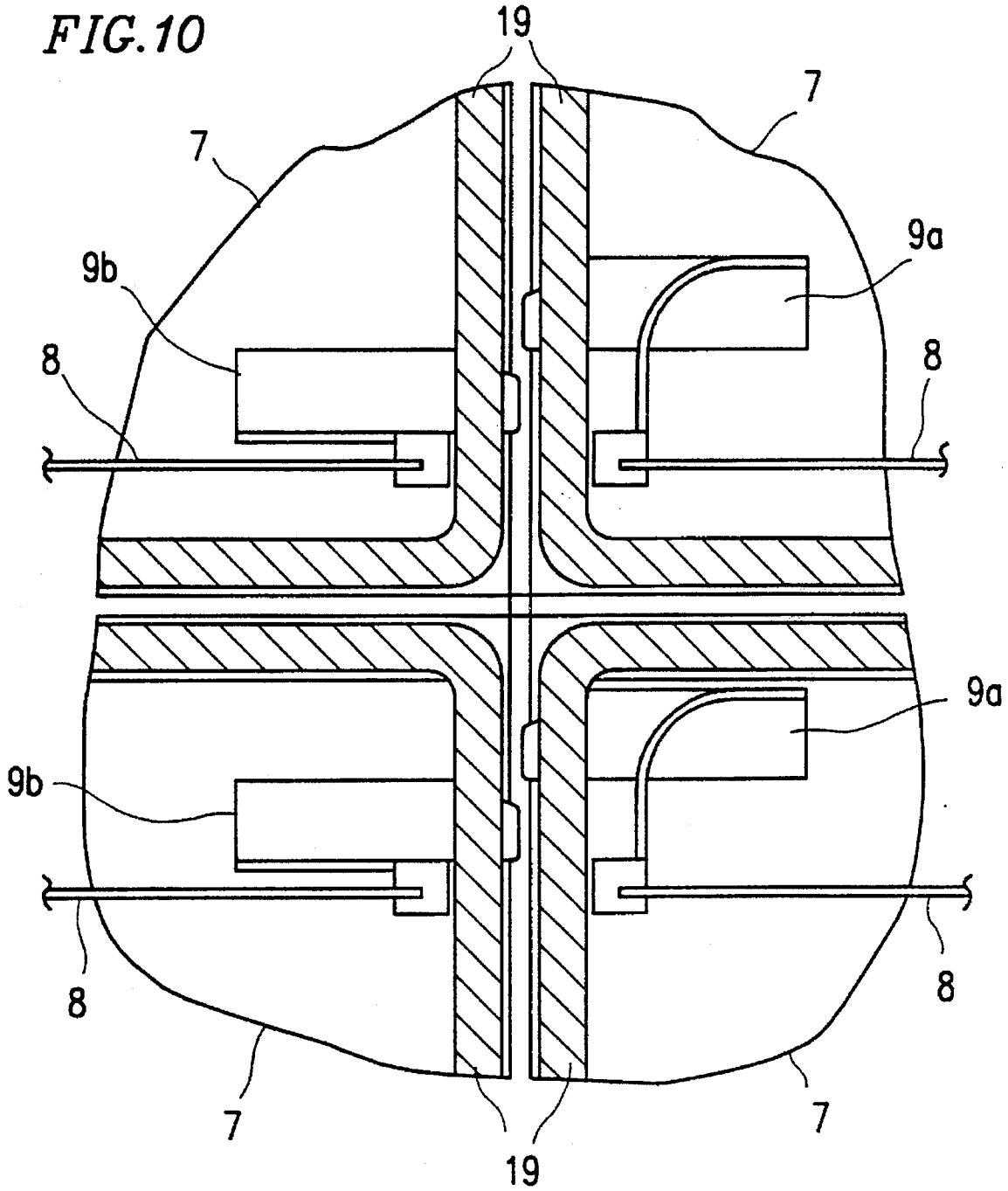
FIG. 10 is a partial plain view of the luminescent panel in FIG. 6, illustrating positional relations between spring terminals and fixed terminals for filaments.

FIG. 10 is a partial plain view showing positional relations among the spring terminals 9*a* and the fixed terminals 9*b* at both ends of the adjacent filaments 8 in a case where many luminescent panels of this example of the invention are arranged in a matrix, whereas unnecessary components for description here, such as the front plate 16 or the insulating plate 11, are not shown. As can be seen from FIG. 10, the spring terminals 9*a* and the fixed terminals 9*b* are positioned with a positional shift therebetween. Therefore, even in a case where the spring terminals 9*a* and the fixed terminals 9*b* are extended to the side surface of the rear plate 7, a pitch between the adjacent luminescent panels is not increased or hardly increased.

A typical external size of the luminescent panel 300 of this example of the invention is 224 mm×112 mm. In addition, a picture element array pitch is 7.0 mm, the number of picture elements is 32×16, the number of the filaments 8 is 16, the number of the anodes 17 is 32×3, and a pitch of lead lines 17*a*–17*c* for the anodes 17 is 2.33 mm.

As described above, the luminescent panel 300 of this example of the invention has characteristics that both terminals 9*a*,9*b* of the filaments 8 are extended to the side surface of the rear plate 7, and the lead lines 17*a*–17*c* of the anodes 17 are collected in column units and extended at least to the side surface of the front plate 16, as well as the aforementioned characteristics of the luminescent panel 200 in the first example. As a result, even when many luminescent panels 300 are arranged in the form of matrix so as to provide a large screen, the external driving wirings can be easily provided. Furthermore, the external wirings can be simplified. In addition, the outer peripheral wall 19 makes it possible to improve the airtightness of the hermetic container formed by the rear plate 7, the insulating plate 11 and the front plate 16, thus resulting in improved operation properties of the luminescent panel 300.

EXAMPLE 3

Next, as a third example, there will be given a description of advantages obtained by appropriately selecting a kind of rare gas used as a discharge gas in a luminescent panel of the invention and its gas pressure. Although the following description will be made by referring to the luminescent panel having the same structure as the luminescent panel 200 in the first example, the same advantages can be obtained by the luminescent panel 300 in the second example.

The luminescent panel of the invention is of a hot cathode type, and mixed gas of mercury gas and rare gas is confined as a discharge gas in the cavities 15*a*–15*c* which constitute the discharge rooms. The optimum operation temperature is 80° to 100° C., and more preferably 80° to 90° C. A surface temperature of the luminescent panel increases with operational process of the luminescent panel, which means an increase in operation temperature. When the operation temperature becomes higher than the above-described optimum temperature, luminous brightness is reduced. In addition, when the surface temperature of the luminescent panel is excessively increased, the container may be damaged. Moreover, the emitter of the surface of the respective filaments 8 is likely to partially disappear or scatter because of ion bombardment caused by heat generation of the filaments 8 and the discharge, thus the surfaces of the phosphor layers 13*a*–13*c* and the surfaces of the front plate 16 could be contaminated. In order to prevent the above problems, an excessive increase in the surface temperature of the luminescent panel during the operation should be prevented.

The surface temperature of the luminescent panel depends on the heating temperature of the filaments 8 and the thermal conductivity of the confined gas. In this example of the invention, Kr gas or Xe gas having a low thermal conductivity is selected as the rare gas contained in the mixed gas, which serves as the discharge gas. Furthermore, Kr gas or Xe gas is confined with a relatively low gas pressure.

Since a thermal conductivity of gas is inversely proportion to its molecular weight, Kr gas or Xe gas having a low thermal conductivity has a large molecular weight. Therefore, by using Kr gas or Xe gas as the discharge gas, dispersion of emitter particles caused by the ion bombardment is blocked by such gases having a large molecular weight, and wastage of the emitter can be reduced.

The filaments 8 used in the luminescent panel of this example have a core member of a tungsten wire or a tungsten wire containing rhenium. The emitter, which is provided on the core member, has barium oxide and strontium oxide as main elements, and zirconium or zirconium oxide ($ZrO_2$) is added thereto by 2 to 10 wt %. The zirconium or zirconium oxide is added to improve resistance against the ion bombardment. The emitter may further contain calcium oxide as another main element.

The advantages obtained in the luminescent panel of this example will be described in detail hereinafter. An external size of the luminescent panel is 230 mm×120 mm, a picture element array pitch is 7.0 mm, the number of picture elements is 32×16, the number of filaments is 16, the number of anodes is 32×3, and a pitch of anode lead lines is 2.33 mm.

As a core member of each filament 8, a tungsten wire with diameter of 20 μm is used. The surface of the core wire is coated with the emitter having barium oxide (BaO), strontium oxide (SrO) and calcium oxide (CaO) as the main elements. A molar composition ratio of the oxides in the emitter is BaO:38.8%, SrO:46.0% and CaO:15.2%. In addition to these main elements, zirconium oxide ($ZrO_2$) is further added by 5 wt %. Since the melting point of $ZrO_2$ added to the emitter is high and its vapor pressure is low at a high temperature, it is possible to prevent diffusion of the emitter caused by the ion bombardment or the heat generation of the filaments. The emitter is preferably 33 to 38 μm in thickness.

Figure 11:
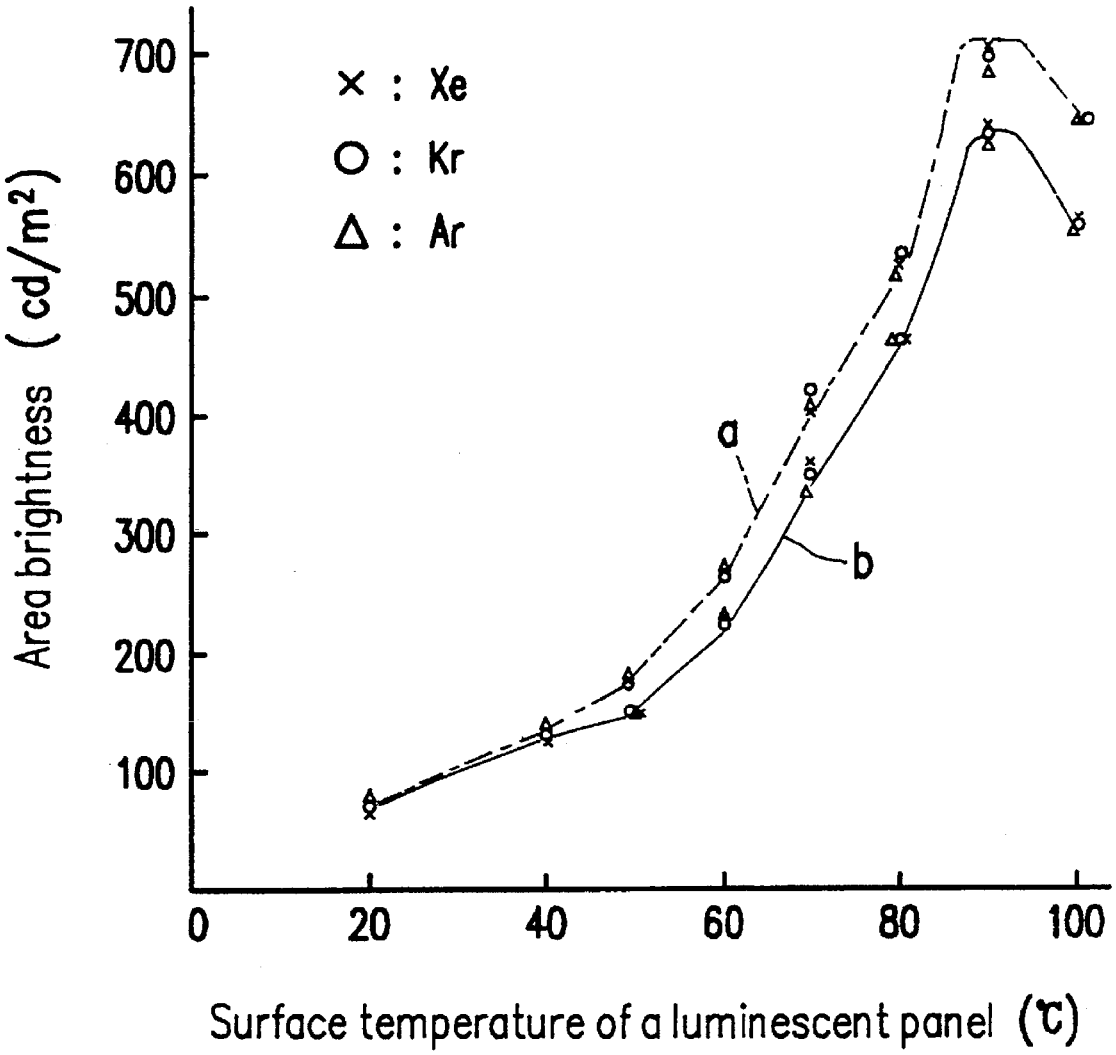
FIG. 11 is a graph illustrating the relationship between surface temperature and area brightness in the luminescent panel.

FIG. 11 is a graph showing the relationship between surface temperature and area brightness of the luminescent panel. A curved line (a) shows the case where gas pressure of the confined discharge gas is 20 Torr, and a curved line (b) shows the case where it is 2 Tort. In addition, three kinds of signs indicate the cases where Xe gas, Kr gas and Ar gas are used as the rare gas, respectively. Thus, it is found that high area brightness can be obtained when the surface temperature of the luminescent panel is 80° to 100° C., and preferably 90° C. In this situation, a temperature at which the highest area brightness is obtained (refereed to as a highest brightness temperature hereinafter) depends on gas pressure of the mercury vapor confined with the rare gas.

Figure 12:
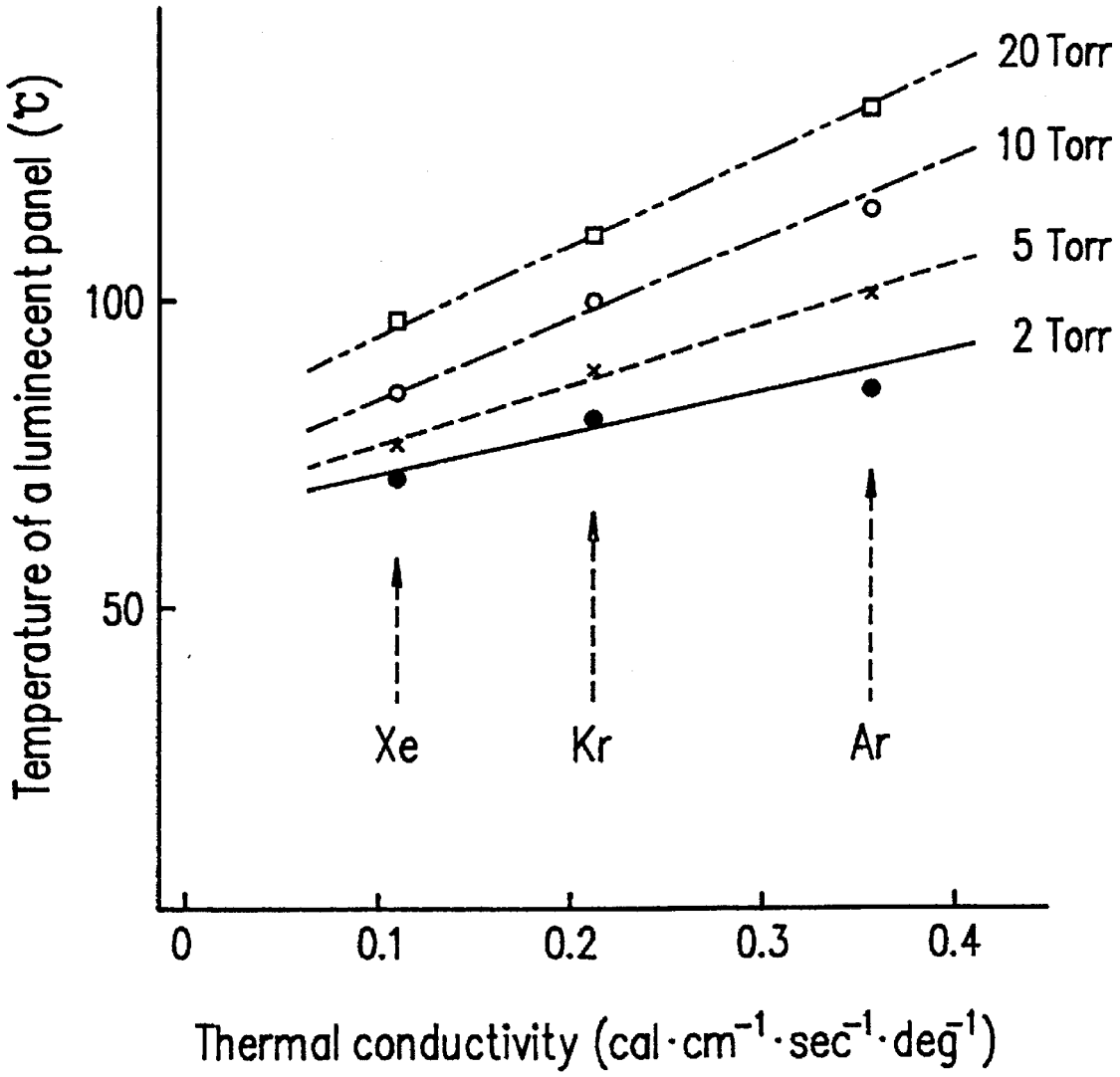
FIG. 12 is a graph illustrating the relationship between thermal conductivity of rare gases used as one component in the discharge gas and temperature of the luminescent panel.

FIG. 12 is a graph showing the relationship between thermal conductivity of the rare gases and temperature of the luminescent panel, while the rare gas elements in the discharge gas and its gas pressure are varied. Xe gas, Kr gas and Ar gas are used as the rare gas and the gas pressure is varied within a range of 2 to 20 Torr. Referring to FIG. 12, the results corresponding to Xe gas, Kr gas and Ar gas are plotted in order of the value of a thermal conductivity.

AS can be seen from FIG. 12, when Xe gas or Kr gas is used as the rare gas to be mixed in the discharge gas and the gas pressure is set within a range of 2 to 20 Torr, the surface temperature of the luminescent panel can be easily kept in the vicinity of 90° C., which is the highest brightness temperature, by slightly heating/cooling the luminescent panel. When Ar gas is used, however, even when the gas pressure is 2 Torr, the temperature of the luminescent panel already becomes in the vicinity of 90° C., and the temperature tends to further increase with increases in the gas pressure. Therefore, in order to obtain high area brightness with Ar gas mixed, the luminescent panel has to be fully cooled off.

Figure 13:
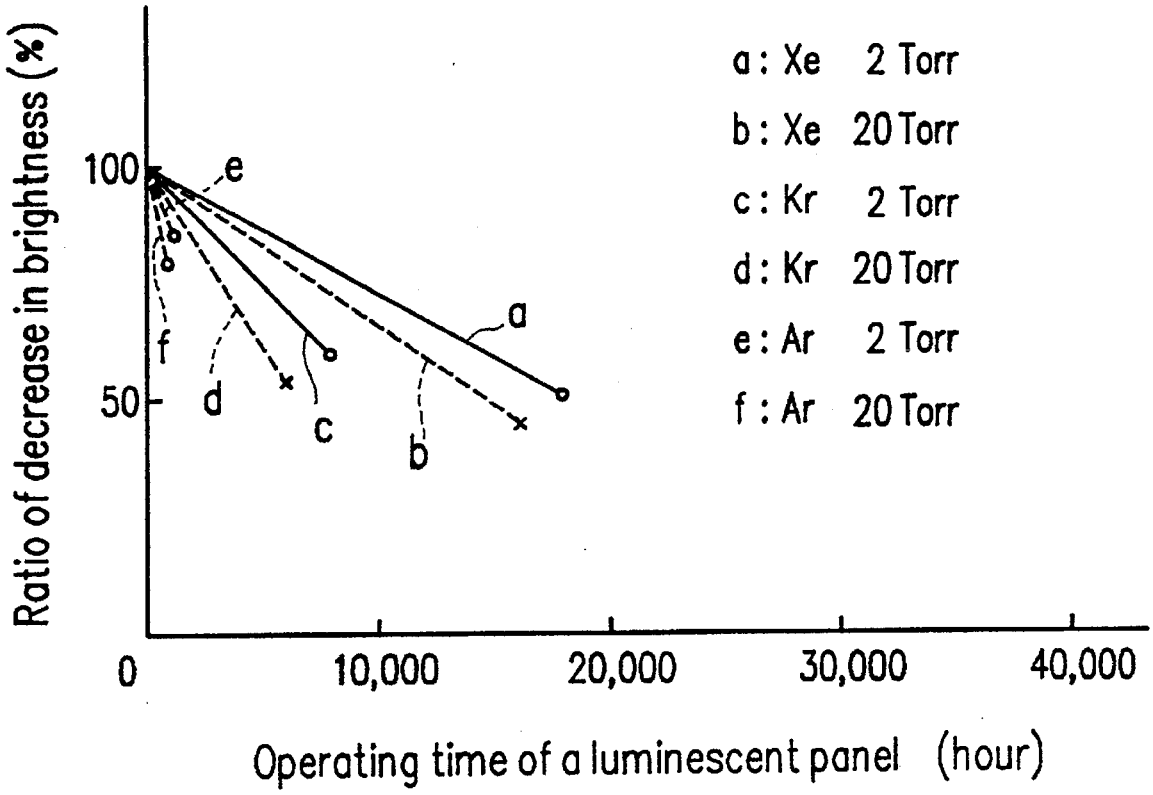
FIG. 13 is a graph illustrating operation characteristics of the luminescent panel in the case where no zirconium oxides are added to the emitter of the filament.
Figure 14:
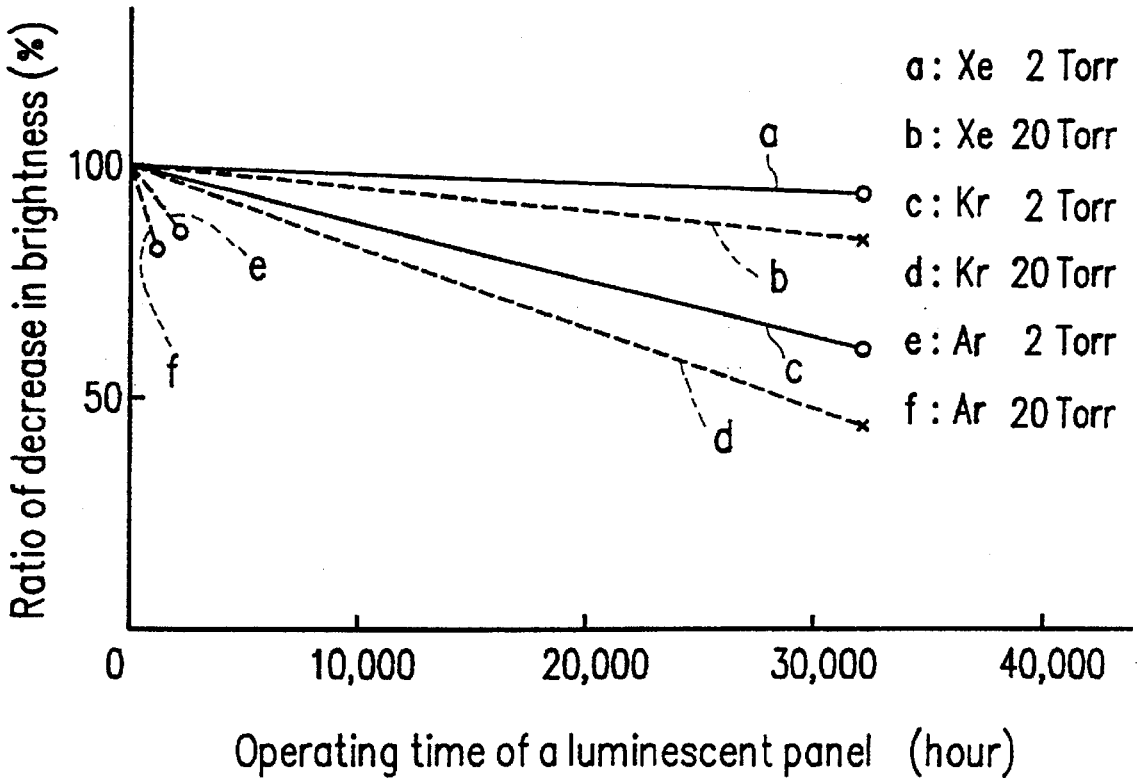
FIG. 14 is a graph illustrating operation characteristics of the luminescent panel in the case where zirconium oxides are added to the emitter of the filament.

FIGS. 13 and 14 are graphs showing operation characteristics of the luminescent panels when the rare gas elements in the discharge gas and its gas pressure are varied. FIG. 13 shows the case where $ZrO_2$ is not added to the emitter of the filament 8, and FIG. 14 is a result of the case where $ZrO_2$ is added by 5 wt %. In both graphs, curved lines (a) to (f) show the relationship between operating time of the luminescent panel and ratio of decrease in brightness for combinations of the rare gas elements and the confined gas pressure, as shown in the figures. In addition, the ratio of decrease in brightness is shown by percentage, normalizing brightness at the beginning of operation.

As can be made clear from the FIGS. 13 and 14, in the case where $ZrO_2$ is added (FIG. 14) and Kr or Xe gas is used as the rare gas to be mixed in the discharge gas, the decrease in brightness is slower than other cases, so that the span of life can be extended. In addition, even when both Xe gas and Kr gas are mixed and used in the discharge gas, the same advantages can be achieved.

The above described advantages are not sufficiently obtained when added $ZrO_2$ is less than 2 wt %. Also, electron emitting efficiency is lowered when $ZrO_2$is added beyond 10 wt %. Thus, $ZrO_2$ is preferably added within a range of 2 to 10 wt %. Alternatively, even when Zr is used instead of $ZrO_2$, the same advantages described above can be obtained.

EXAMPLE 4

A driving system used for driving the luminescent panel of the invention will be described.

Figure 15:
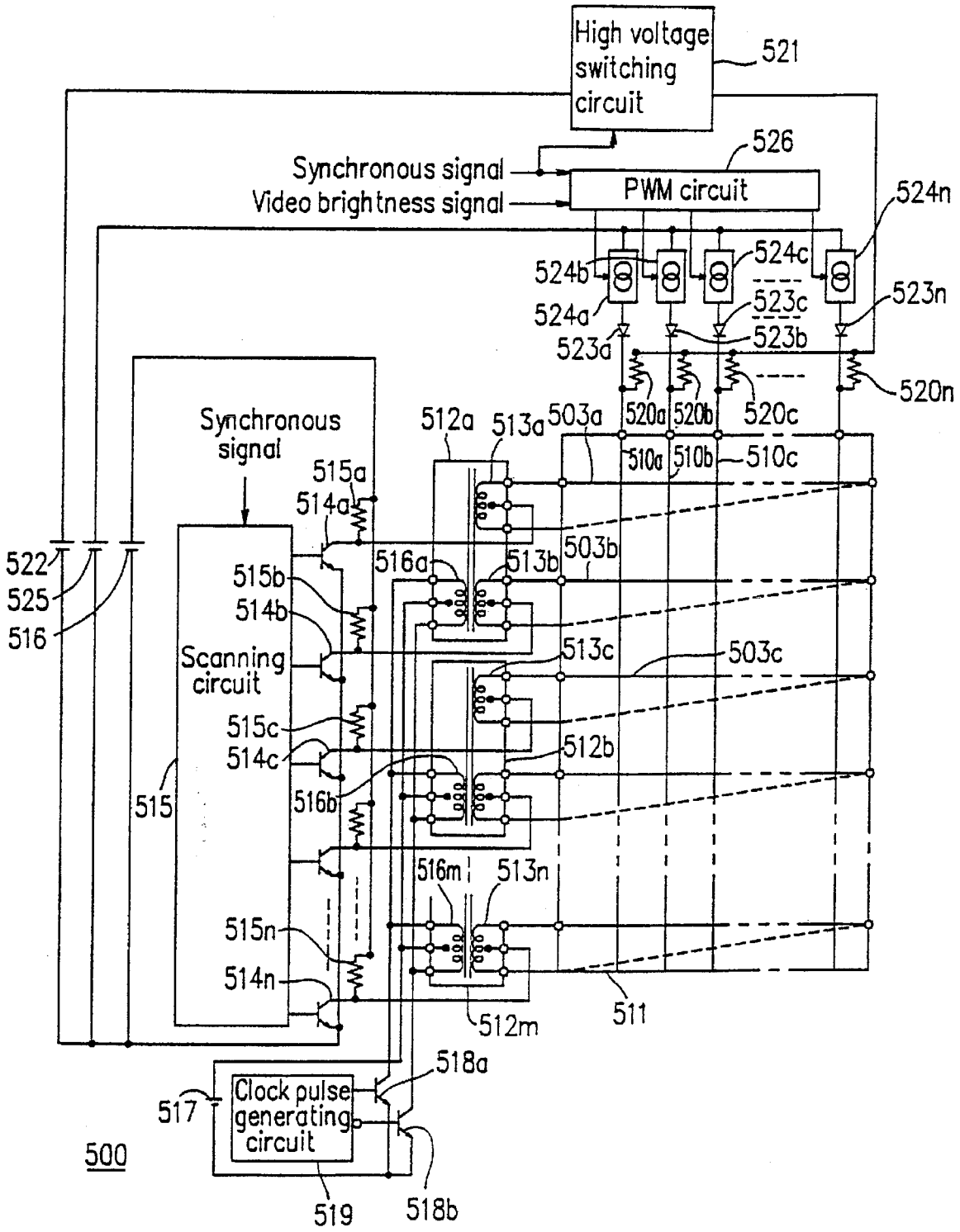
FIG. 15 illustrates a circuit diagram of a driving system for the luminescent panel in accordance with a fourth example of the present invention.

FIG. 15 is a circuit diagram showing a driving system 500 of this example of the invention, which corresponds to a piece of a luminescent panel 511. The luminescent panel 511 of the example has filaments 503*a*–503*n* arranged with a pitch of 7 mm and serving as cathodes, and lead lines 510*a*–510*n* of anodes (referred to as anode lines hereinafter) arranged with a pitch of 2.33 mm. Typically, there are 16 rows of the filaments and 96 columns of the anode lines.

The respective filaments 503*a*–503*n* are connected to respective secondary windings 513*a*–513*n* of transformers 512*a*–512*m*. In addition, transistors 514*a*–514*m* for switching are connected to center taps provided in the secondary windings 513*a*–513*n*, respectively. The transistors 514*a*–514*n* are sequentially inverted to an ON state for a short period of time by an output signal of a scanning circuit 515, whereby the filaments 503*a*–503*n* are selectively scanned in a sequential manner. The transistors 514*a*–514*n* are connected to a bias power supply 516 of DC 200 V via respective resistors 515*a*–515*n*.

Primary windings 516*a*–516*m* of the transformers 512*a*–512*m* are connected to a power supply 517 of DC 20 V through two transistors 518*a* and 518*b* for generating an alternating voltage. Both of the transistors 518*a* and 518*b* are alternately inverted to an ON state by an output signal of a clock pulse generating circuit 519, whereby an alternating square wave voltage is applied to the primary windings 516*a*–516*m*.

Meanwhile, the anode lines 510*a*–510*n* of the luminescent panel 511 are connected to a discharge igniting power supply 522 of DC 300 V through a high-voltage switching circuit 521 and resistors 520*a*–520*n* for confining a current, respectively. At the same time, the anode lines 510*a*–510*n* are connected to a discharge sustaining power supply 525 of DC 100 V through diodes (first diodes) 523*a*–523*n* for restricting an inverse current flow and constant current circuits 524*a*–524*n*.

Figure 1:
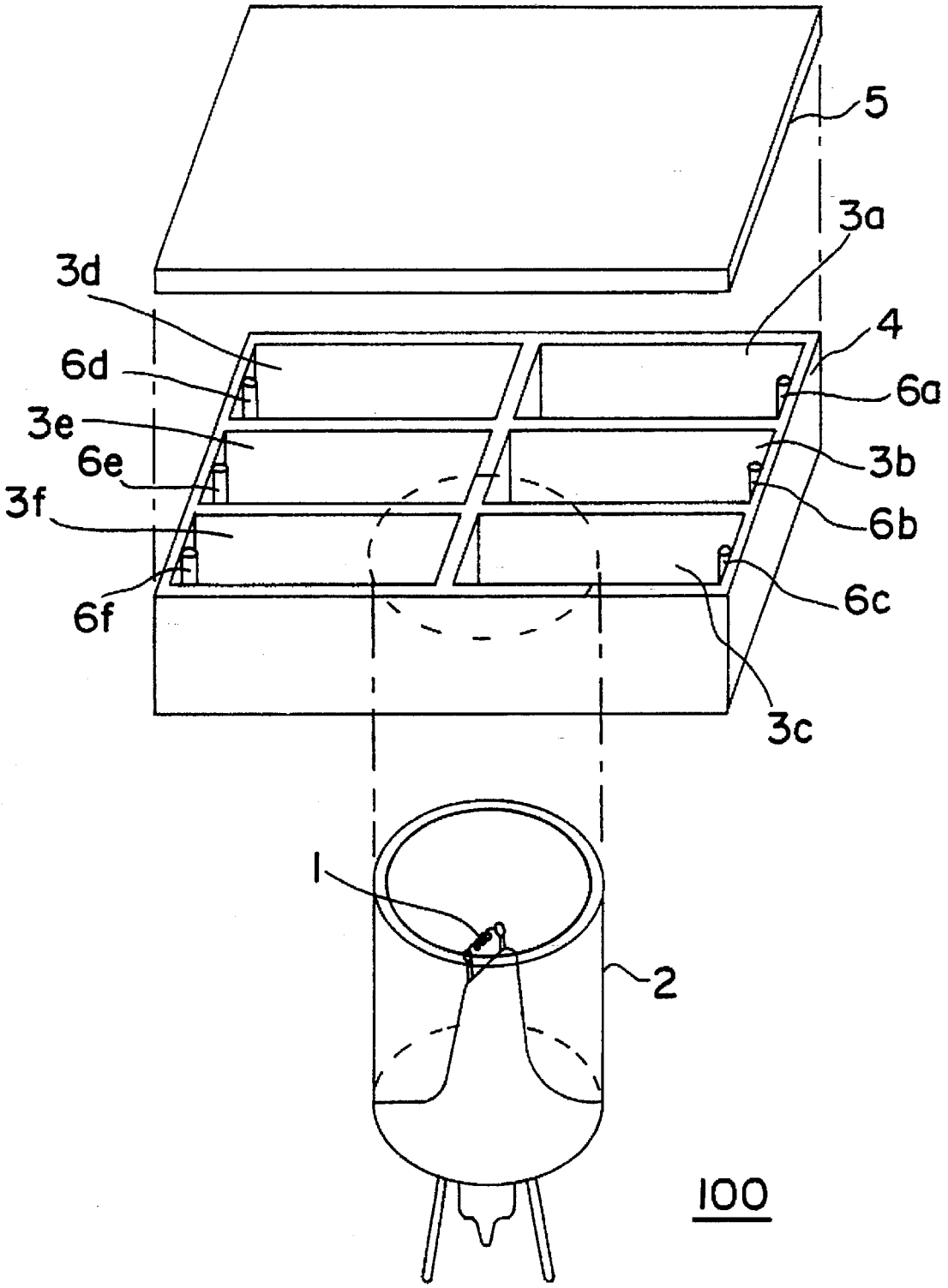
FIG. 1 PRIOR ART
FIG. 1 is a perspective view illustrating an example of a structure of a conventional luminescent panel of a hot cathode type.

A PWM circuit 526 connected to the constant current circuits 524*a*–524*n* generates a PWM modulation signal having a pulse width corresponding to a video brightness signal in synchronization with the sequential and selective scanning of the filaments 503*a*–503*n*. Meanwhile, the high-voltage switching circuit 521 conducts for a moment in synchronization with selective scanning of the filaments 503*a*–503*n*. Consequently, a high-voltage pulse for igniting the discharge is applied to the anode lines 510*a*–510*n*, and the weak discharge occurs between the selected filament and anode line. Thereafter, a low-voltage signal for sustaining the discharge having a time width corresponding to desired luminous brightness is applied to the anode line corresponding to a picture element to be lit up, whereby a current with a pulse width corresponding to the video brightness signal is supplied through the constant current circuits 524*a*–524*n*. As a result, the main discharge occurs and images are displayed. Referring to the high-voltage pulse for igniting the discharge, a voltage peak value is typically 300 V and a pulse width is typically 50 μs. In addition, the low-voltage signal for sustaining the discharge is typically 100 V. An example of utilizing the above described PWM circuit 526 and the high voltage switching circuit 521 in the driving system for the conventional luminescent panel 100 using a fluorescent lamp as shown in FIG. 1 is disclosed, for example, in Japanese Laid-Open Patent Publication No. 3-39988.

FIGS. 16A to 16E respectively show cathode voltage waveforms and a discharge current waveform obtained in the driving system in FIG. 15.

Figure 16A:
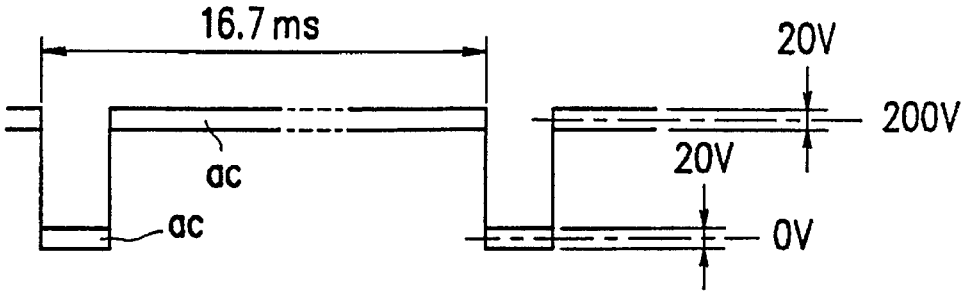
FIGS. 16A–16E respectively illustrate cathode voltage waveforms and a discharge current waveform obtained in the driving system in FIG. 15.
Figure 16B:
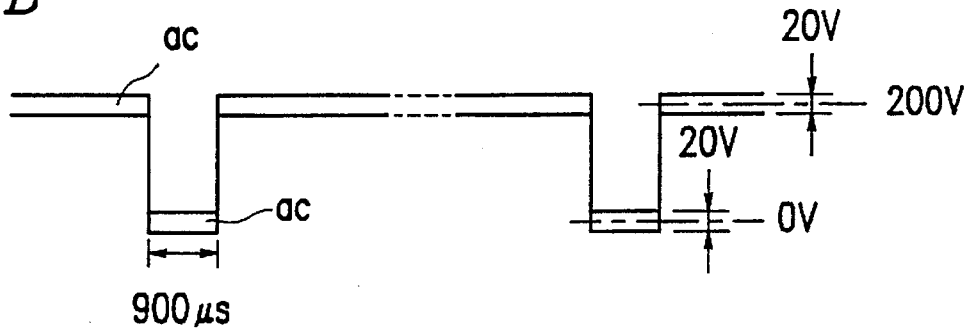

FIGS. 16A and 16B are voltage waveforms at both ends of "(n−1)"th and "n"th filaments respectively. Since a cycle of the selective scanning of the filaments 503*a*–503*n* is 16.7 ms, a selecting period for each filament is 900 μs. As shown in FIGS. 16A and 16B, an alternating voltage element "ac" of amplitude 20 V for filament-heating, which is supplied from the secondary windings 513*a*–513*n* of the transformers 512*a*–512*m*, is superimposed to the voltage waveforms. Consequently, the voltage waveforms at both ends of the filaments are such that an alternating voltage element which oscillates at an amplitude of 20 V with a bias voltage level of 0 V or 200 V as the center of oscillation is superimposed onto a square wave with an amplitude of 200 V. In FIGS. 16A and 16B, such a state superimposed with the alternating voltage element is designated by a square region labeled as "ac".

Figure 16C:
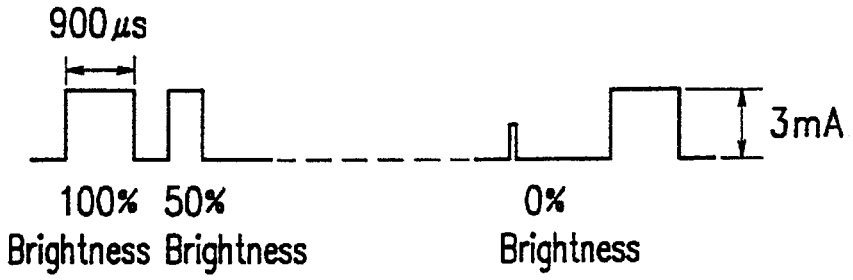

FIG. 16C shows a discharge current waveform flowing across the anode lines 510*a*–510*n*. A constant current of 3 mA flows with a pulse width corresponding to the video brightness signal. For example, the current pulse corresponding to the signal with a video brightness of 100% has a width of 900 μs, while the current pulse corresponding to the signal with a video brightness of 50% has a width of 450 μs.

Figure 16D:
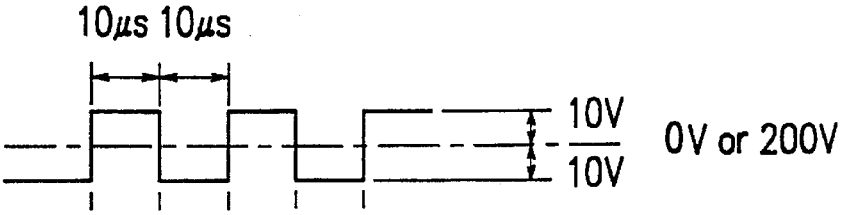
Figure 16E:
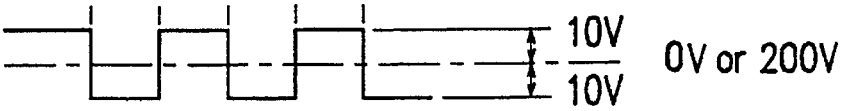

FIGS. 16D and 16E are waveforms provided by enlarging the alternating voltage element "ac" shown in FIG. 16A or 16B regarding one filament. FIG. 16D shows a voltage waveform measured at one end of the filament and FIG. 16E shows a voltage waveform measured at the other end thereof. As can be seen from a comparison of FIGS. 16D and 16E, there is a phase shift of 180° between both waveforms.

Since the square alternating voltage with an amplitude of 20 V is superimposed to both ends of the filament, each filament is heated up by the alternating square wave voltage with an amplitude of 40 V. Thus, each of the filaments is typically heated up to approximately 800° C. (approximately 1 W). A polarity of the alternating voltage element "ac" is inverted every 10 μs, which is sufficiently short as compared with a period (900 μs) for selecting the filament.

A 0 V potential of the above-described voltage waveforms corresponds to a negative potential line of each of the bias power supply 516, the discharge sustaining power supply 525 and the discharge igniting power supply 522 which are shown in FIG. 15.

In the driving system according to this example of the invention, as described above, the center taps are provided in the secondary windings 513*a*–513*n* of the transformers 512*a*–512*m*, and the transistors 514*a*–514*n* for switching are connected thereto. Thus, the alternating voltage element "ac" with an amplitude of 20 V applied to both ends of the filaments 503*a*–503*n* is divided in halves when the corresponding transistors 514*a*–514*n* are turned on. The anode voltage is prevented from changing by the reduced half of the amplitude. As a result, a power burden of the constant current circuits 524*a*–524*n* can be lightened. In addition, since the voltage at both ends of each of the filaments 503*a*–503*n* is alternately changed so as to be well-balanced, a discharge current flowing through anode lines 510*a*–510*n* arranged crossing the filaments 503*a*–503*n* can be uniformly distributed on the filaments 503*a*–503*n*. Consequently, heating of the filaments 503*a*–503*n* and current distribution thereon can be uniformly implemented.

EXAMPLE 5

Next, another driving system used for driving the luminescent panel of the invention will be described.

Figure 17:
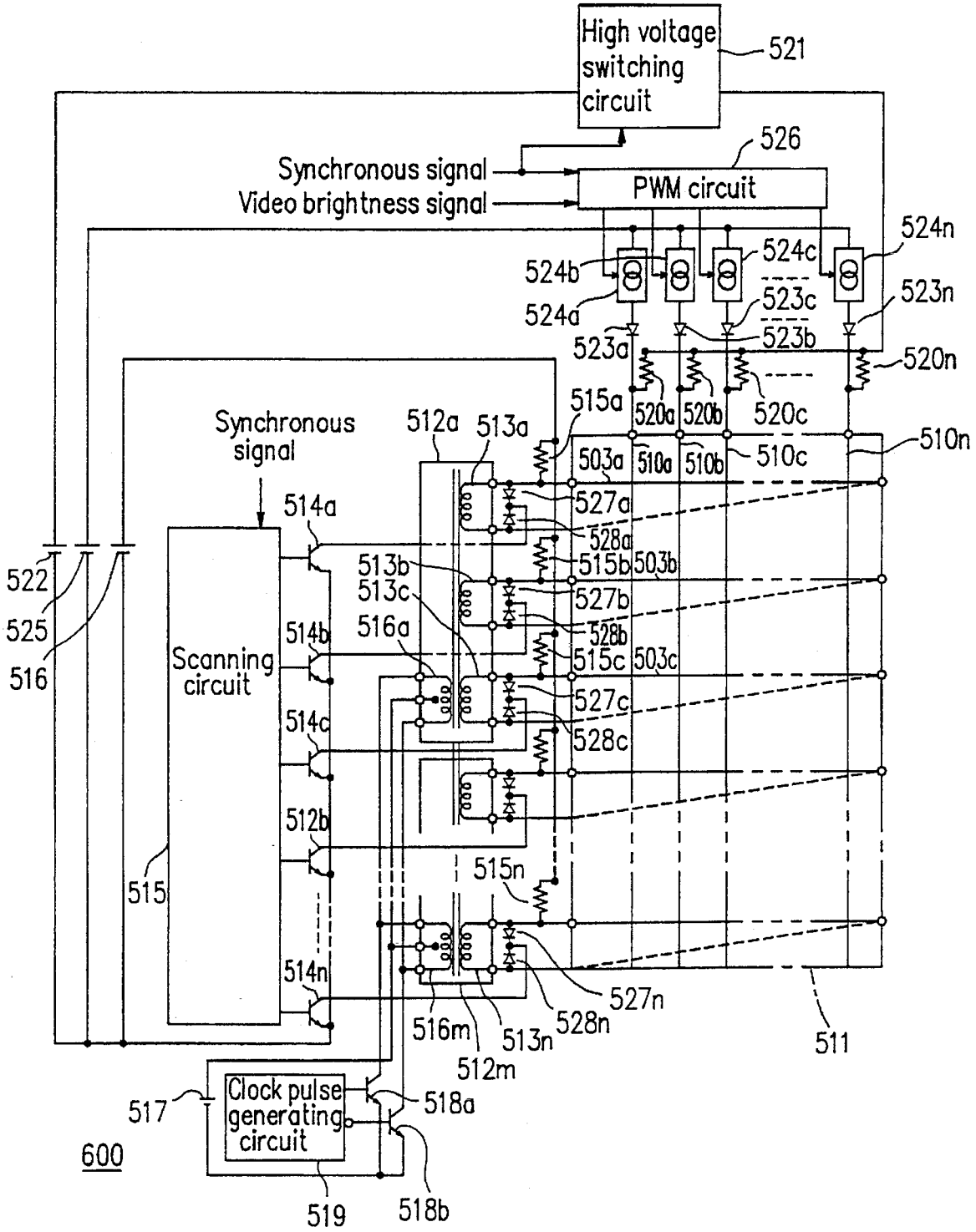
FIG. 17 illustrates a circuit diagram of a driving system for the luminescent panel in accordance with a fifth example of the present invention.

FIG. 17 is a circuit diagram showing a driving system 600 according to this example of the invention, which corresponds to a piece of the luminescent panel 511, similarly in FIG. 15. The driving system 600 of this example basically has the structure similar to the driving system 500 described in the fourth example. The similar elements have the same reference numerals and the detailed descriptions thereof will be omitted.

The driving system 600 of this example differs from the driving system 500 in the fourth example in the following three aspects.

First, in the driving system 600 of this example, the center taps are not provided in the secondary windings 513*a*–513*n* of the transformers 512*a*–512*m* which supply power to the filaments 503*a*–503*n*. Instead of the center taps, second diodes 527*a*–527*n* and third diodes 528*a*–528*n* are used. A positive terminal of each of the second diodes 527*a*–527*n* is respectively connected to one end of each of the secondary windings 513*a*–513*n*, and a positive terminal of each of the third diodes 528*a*–528*n* is connected to the other end thereof. Furthermore, the transistors 514*a*–514*n* for switching are connected to respective connecting points between negative terminals of the second and third diodes 527*a*–527*n* and 528*a*–528*n*.

Secondly, the driving system 600 of this example has the resistors 515*a*–515*n* for supplying the bias voltage connected to one end of the secondary windings 513*a*–513*n*, respectively.

Thirdly, in the driving system 600, a voltage of the discharge sustaining power supply 525 is set at 90 V.

In addition to the above-mentioned three aspects, the number of secondary windings 513*a*–513*n* per each of the transformers 512*a*–512*m* is two in the driving system 600, while the number is three in the driving system 500.

Figure 18A:
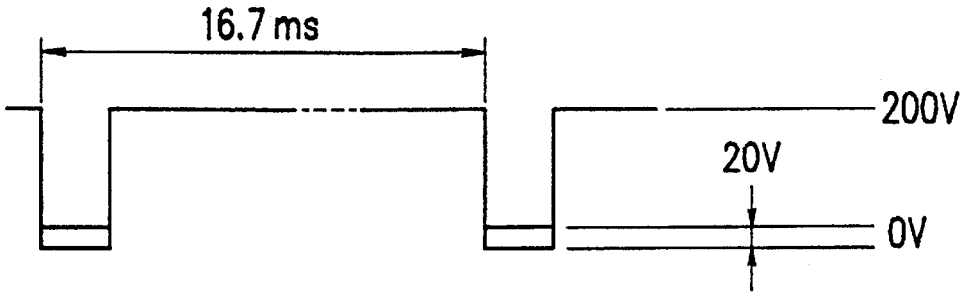
FIGS. 18A–18E respectively illustrate cathode voltage waveforms and a discharge current waveform obtained in the driving system in FIG.
Figure 18B:
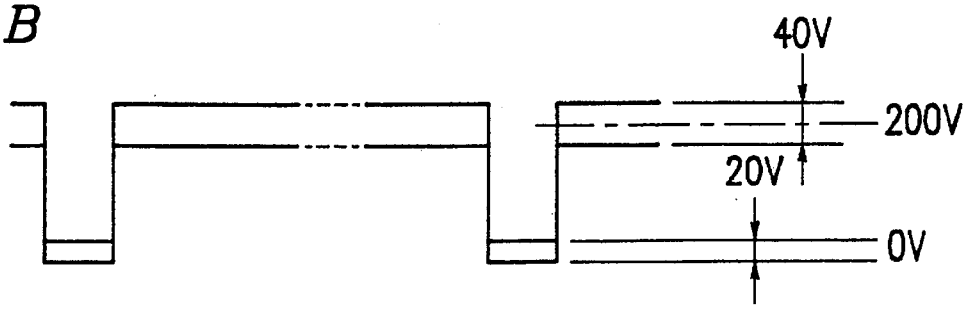
Figure 18C:
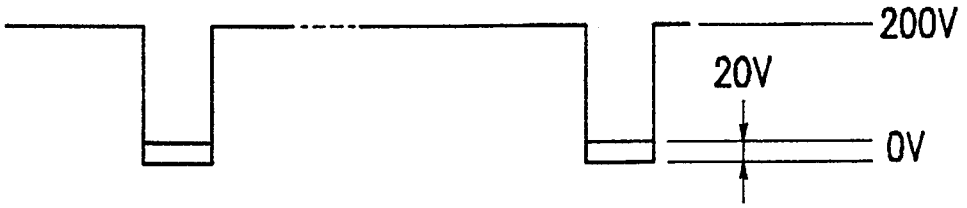
Figure 18D:
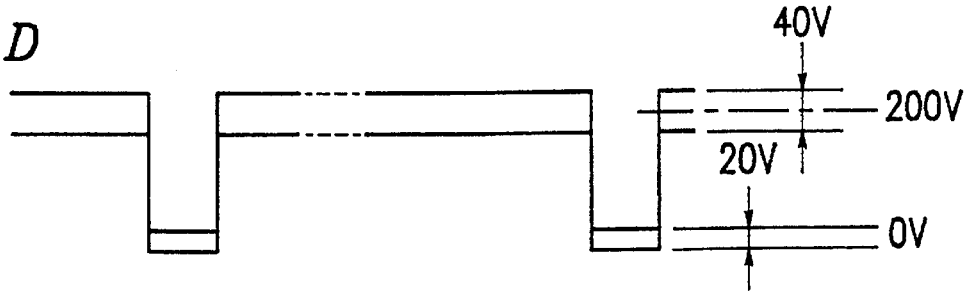

When the thus formed driving system 600 is used, voltages having waveforms as shown in FIGS. 18A to 18D are applied to respective ends of each of the filaments 503*a*–503*n* of the luminescent panel 511. More specifically, FIG. 18A shows a voltage waveform applied to one end of the "(n–1)"th filament 503(n–1) (to which the resistor 515(n–1) is connected), and FIG. 18B shows a voltage waveform applied to the other end of the "(n–1)"th filament 503(n–1). Similarly, FIG. 18C shows a voltage waveform applied to one end of the "n"th filament 503*n* (to which the resistor 515*n* is connected), and FIG. 18D shows a voltage waveform applied to the other end of the "n"th filament 503*n*.

These voltage waveforms differ from the voltage waveforms obtained by the driving system 500 of the fourth example of the invention (referring to FIGS. 16A, 16B, 16D and 16E) in the following two aspects.

First, during a selecting period of sequential scanning of the filaments 503*a*–503*n*, although the alternating voltage element "ac" for filament-heating with an amplitude of 20 V is superimposed with 0 V put in the center (between –10 V to +10 V at a voltage level) in the driving system 500, it is shifted so as to be superimposed within a range of 0 V to –20 V in the driving system 600. This is because the transistors 514*a*–514*n* for switching are connected to the secondary winding 513*a*–513*n* through the second and third diodes 527*a*–527*n* and 528*a*–528*n*, respectively.

Secondly, during a non-selecting period of sequential scanning of the filaments 503*a*–503*n*, the alternating voltage element "ac" with the bias potential (200 V) put in the center is not superimposed to the ends of the filaments 503*a*–503*n*, to which end the resistors 515*a*–515*n* for supplying the bias voltage are connected, respectively (referring to FIGS. 18A and 18C). Meanwhile, the alternating voltage element "ac" (40 V) with the bias potential (200 V) put in the center is superimposed to the other ends of the filaments 503*a*–503*n*. This is because the resistors 515*a*–515*n* are connected to one end of the secondary windings 513*a*–513*n*, respectively.

Figure 18E:
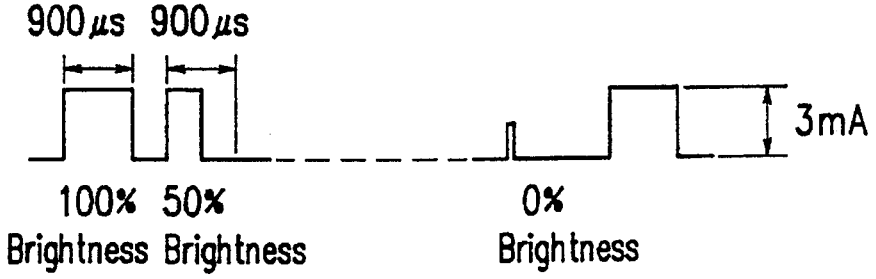

FIG. 18E shows a discharge current waveform flowing in the anodes, which is the waveform similar to that in the driving system 500 shown in FIG. 16C.

The driving system 600 operates as follows.

When an alternating voltage for filament-heating with an amplitude of 40 V is induced in each of the secondary windings 513*a*–513*n* of the transformers 512*a*–512*m*, the either ones, to which a forward voltage is applied, of the second diodes 527*a*–527*n* or the third diodes 528*a*–528*n* are turned on, and the other ones thereof, to which a reverse voltage is applied, are turned off. Meanwhile, the discharge current flowing into the selected one of the filaments 503*a*–503*n* separately flows to both ends of the particular filament. Thus, the current flows from one end of the filament into the corresponding secondary winding. In addition, the current also flows from the other end into the diode which is in an ON state and returns to the power supply through the selected transistor for switching. An output voltage of each of the secondary windings 513*a*–513*n* repetitively inverts its polarity for a selecting period of the filaments.

As shown in FIGS. 18A to 18D, an amplitude of the alternating voltage element "ac" appeared on the voltage waveforms at both ends of the filament becomes half of that appeared between both ends of each of the secondary windings 513*a*–513*n*. As a result, the voltage of the anodes is prevented from being changed by the reduced half of the amplitude. More specifically, a power burden of the constant current circuits 524*a*–524*n* is lightened. However, since the alternating voltage element "ac" is shifted by 10 V in the negative direction, the voltage of the discharge sustaining power supply 525 is lowered corresponding to the shift so as to be set at 90 V. The power corresponding to the shift of 10 V is supplied from the transformers 512*a*–512*m*.

As shown in FIGS. 18A to 18D, the voltages at both ends of each of the filaments 503*a*–503*n* are alternately changed so as to be well-balanced for the selecting period of the filaments 503*a*–503*n*. Therefore, a discharge current is uniformly distributed on the filaments 503*a*–503*n*, and the heating and current distribution of the filaments 503*a*–503*n* can be made uniform. As a result, the life span of the discharge panel can be extended.

In the driving system 600 of this example, if the resistors 515*a*–515*n* for supplying a bias voltage are connected to the transistors 514*a*–514*n* for switching respectively, similarly to the driving system 500 of the fifth example, the bias voltage is interrupted by the second diodes 527*a*–527*n* and the third diodes 528*a*–528*n*. In order to prevent such a situation, in the driving system 600, the resistors 515*a*–515*n* are connected to one end of the secondary windings 513*a*–513*n*, that is, to the filaments 503*a*–503*n*.

According to the driving system 600 of this example, during the non-selecting period of the filaments 503*a*–503*n*, the alternating voltage element "ac" is not superimposed to the ends of the filaments 503*a*–503*n*, to which end the resistors 515*a*–515*n* are connected. Meanwhile, to the other end, the alternating voltage element "ac" with an amplitude of 40 V is superimposed as it is. In this case, by setting the bias voltage at such a value that the discharge stops for the non-selecting period, a problem regarding the operation is not generated.

As described above, according to the driving system 600 of this example, the second and third diodes 527*a*–527*n* and 528*a*–528*n* are connected to the secondary windings 513*a*–513*n* of the transformers 512*a*–512*m* which supply a heating voltage to the filaments 503*a*–503*n*, respectively. Thus, the center taps are not necessary. Since, the transformers 512*a*–512*m* are of compact type, the size thereof mainly depends not on the windings, but on the number of taps. By reducing the number of taps in the respective second windings 513*a*–513*n*, the number of transformers 512*a*–512*m* to be used can be also reduced. Furthermore, the power burden of the constant current circuit is lightened, and heating of the filaments 503*a*–503*n* and its current distribution can be uniform. Consequently, the life span of the luminescent panel 511 can be extended.

EXAMPLE 6

Next, still another driving system used for driving the luminescent panel of the invention will be described.

Figure 19:
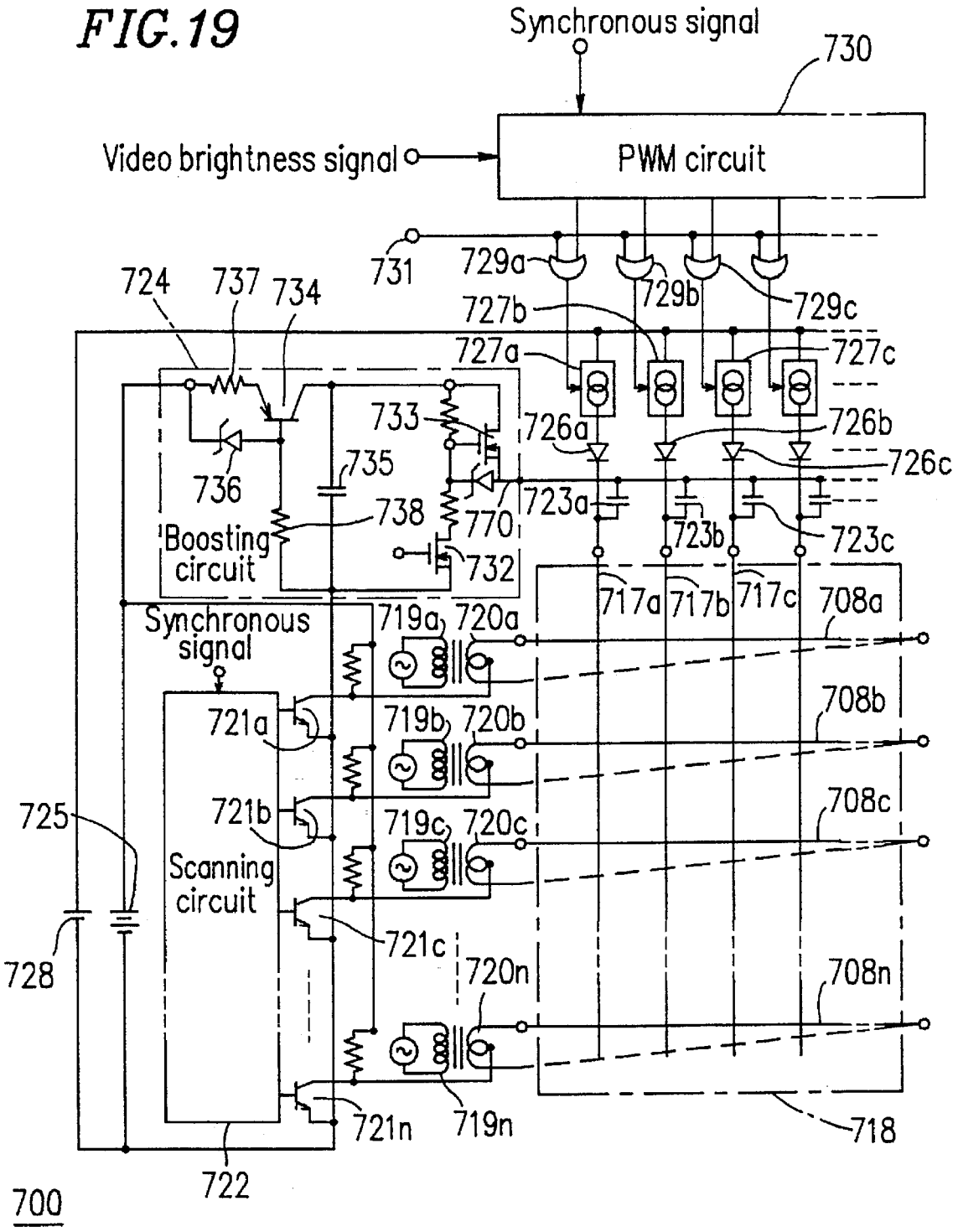
FIG. 19 illustrates a circuit diagram of a driving system for the luminescent panel in accordance with a sixth example of the present invention.

FIG. 19 is a circuit diagram showing a driving system 700 according to this example of the invention, which corresponds to a piece of the luminescent panel 718, similar to the systems in FIGS. 15 and 17.

In the above-described driving systems 500 and 600, the high-voltage pulse for igniting the discharge is applied also to the anodes corresponding to picture elements which are not lit up, for a relatively long time span. In addition, the driving systems require the high-voltage power supply 522 capable of generating a high voltage for supplying the high-voltage pulse in order to ignite the discharge. Meanwhile, a boosting circuit 724 is used in the driving system 700 of this example, instead of the discharge igniting power supply 522.

A structure of the luminescent panel 718 shown in FIG. 19 is similar to those as described previously. In the luminescent panel 718, the number of picture elements is 32×16, an array pitch of picture elements is 7.0 mm, the number of filaments is 16, and the number of anodes is 32×3. Filaments 708*a*–708*n* are connected to secondary windings 720*a*–720*n* of transformers 719*a*–719*n*, respectively. Transistors 721*a*–721*n* for switching are connected to the center taps of the secondary windings 720*a*–720*n*, respectively. The transistors 721*a*–721*n* are controlled so as to be sequentially turned on by a scanning circuit 722, and the filaments 708*a*–708*n* are sequentially scanned by a divided time.

Meanwhile, one end of a plurality of capacitors 723*a*–723*n* for igniting the discharge are connected to a plurality of anode lines 717*a*–717*n*, respectively. The other end of the capacitors 723*a*–723*n* are connected to a signal output end 770 of the boosting circuit 724. In addition, a DC power supply 725 of 200 V is connected to the boosting circuit 724. Additionally, the anode lines 717*a*–717*n* are connected to a DC power supply 728 of 100 V for sustaining the discharge, through diodes 726*a*–726*n* and constant current circuits 727*a*–727*n*, respectively. The constant current circuits 727*a*–727*n* receive on-off control by the OR circuits 729*a*–729*n*, respectively. One signal input terminal of each of the OR circuits 729*a*–729*n* is connected to a PWM circuit 730, and the other signal input terminal thereof is connected to a charge control signal input terminal 731.

A video brightness signal and a synchronous signal are input to the PWM circuit 730 during a horizontal scanning period, whereby the PWM circuit 730 operates. Then, a modulated signal having a pulse width corresponding to the video brightness signal is applied to the constant current circuits 727*a*–727*n* through the OR circuits 729*a*–729*n*, respectively. As a result, the modulation signal which lights up each picture element for a time span corresponding to its luminous brightness is applied to the anode lines 717*a*–717*n* through the diodes 726*a*–726*n*, respectively.

Meanwhile, when the signal is input to the charge control signal input terminal 731 at an initial stage of a horizontal blanking period, the OR circuits 729*a*–729*n* compulsorily turn on the constant current circuits 727*a*–727*n*, respectively. At this time, since the transistor 732 of the boosting circuit 724 is turned on and the potential of the signal output end 770 becomes in the vicinity of 0 V, all of the capacitors 723*a*–723*n* are charged to approximately 100 V. A peak value of the current flowing in at this time is 3 mA×96=288 mA. Just after that, since the transistor 732 is turned off and the transistor 733 is turned on, a boosting voltage of approximately 200 V is output to the signal output end 770. Since the discharge voltage of approximately 100 V is superimposed onto the voltage, a high voltage of approximately 300 V is applied to each of the anode lines 717*a*–717*n*. Thus, when the filaments 708*a*–708*n* are scanned during a horizontal scanning period, a peak current of approximately 8 mA flows from the capacitors 723*a*–723*n* to each picture element for a moment (approximately 1 μs), which induces the weak discharge for igniting the main discharge.

FIGS. 20A to 20J respectively illustrate several kinds of voltage and current waveforms observed in the driving system 700.

Figure 20A:
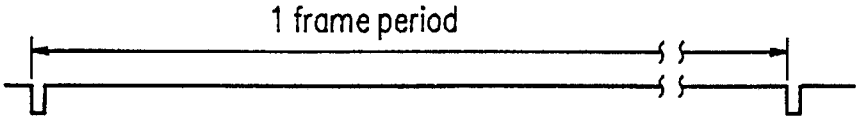
FIGS. 20A–20J respectively illustrate various voltage waveforms and current waveforms observed in the driving system in FIG. 19.
Figure 20B:
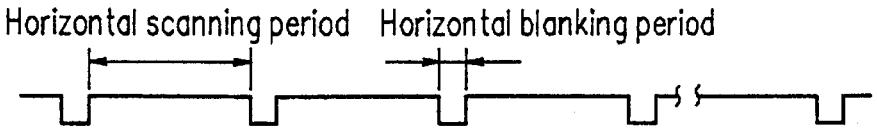
Figure 20C:
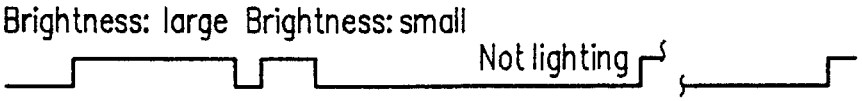

FIG. 20A shows a vertical synchronous signal and FIG. 20B shows a horizontal synchronous signal. One frame period is approximately 17 ms, a horizontal scanning period for one filament is approximately 800 μs, and a horizontal blanking period is approximately 160 μs. FIG. 20C shows a waveform of a signal output from the PWM circuit 730 to any one of the anode lines in an every horizontal scanning period.

Figure 20D:
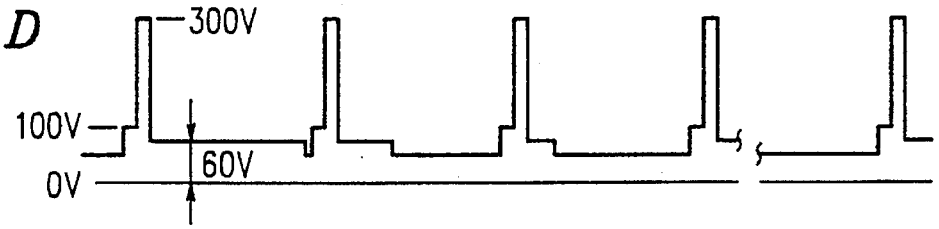
Figure 20E:
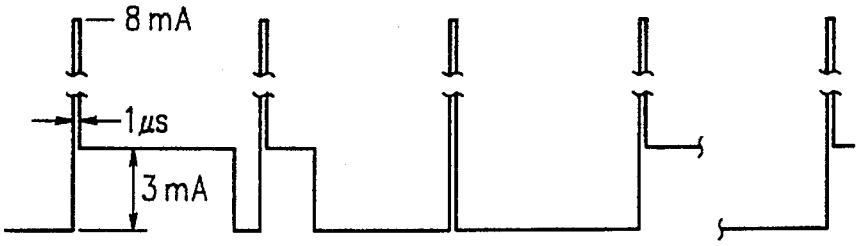

As shown in FIG. 20D, an anode applying voltage is boosted to the discharge igniting voltage (approximately 300 V) as described above in the horizontal blanking period by the capacitors 723*a*–723*n* and the boosting circuit 724. Meanwhile, the discharge current has a peak value of approximately 8 mA for a short period (approximately 1 μs) at an initial stage of the horizontal scanning period as shown in FIG. 20E.

Figure 20F:
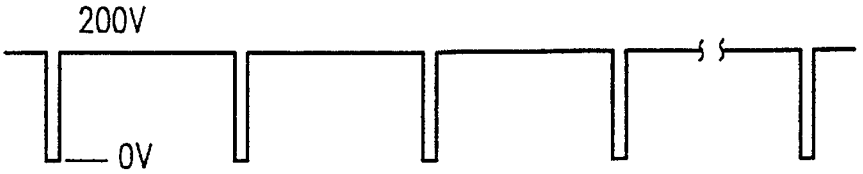
Figure 20G:
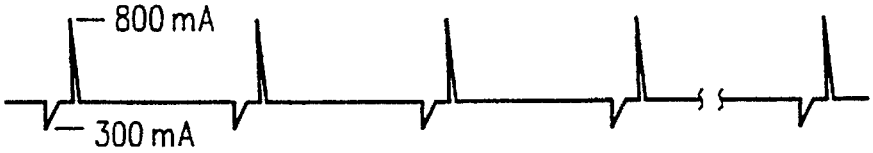
Figure 20H:
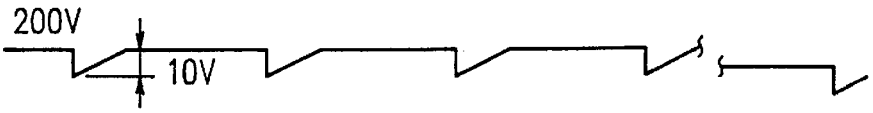
Figure 20I:
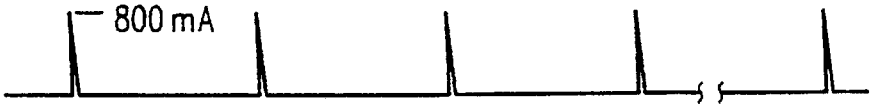
Figure 20J:
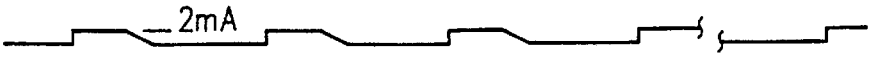

FIGS. 20F and 20G show a voltage waveform and a current waveform at the signal output end 770 of the boosting circuit 724, respectively. FIGS. 20H and 20I show a voltage waveform and a current waveform of a collector of the transistor 734, respectively. FIG. 20J shows a current waveform of the boosting circuit 724 on the power supply input side thereof.

As described above, in the driving system 700 of this example, there is provided a circuit structure using the transistor 734, a capacitor 735, a Zenner diode 736 and resistors 737 and 738 so as to supply a current of a peak value 8 mA×96=768 mA from the signal output end 770 when the peak current of approximately 8 mA instantly flows from each one of the capacitors 723*a*–723*n* to each picture element. Consequently, signal waveforms shown in FIGS. 20H to 20J are provided, and an output impedance of the DC power supply 725 of 200 V seems to be reduced.

By repeating the above-described operations, light emitting intensity of the weak discharge of non-lit picture elements becomes extremely lowered. Therefore, by using the driving system 700 of this example of the invention, an image having high contrast can be displayed. In addition, since the high-voltage pulse for igniting the discharge can be obtained without using the high-voltage power supply, a stable operation of the discharge ignition can be implemented.

In the above description of the driving system 700 of the sixth example of the invention, there are provided the center taps in the secondary windings 720*a*–720*n* of the transformers 719*a*–719*n*, similarly to the driving system 500 of the fourth example. Alternatively, the center taps may not be employed as described in the driving system 600 of the fifth example of the invention.

EXAMPLE 7

Figure 21:
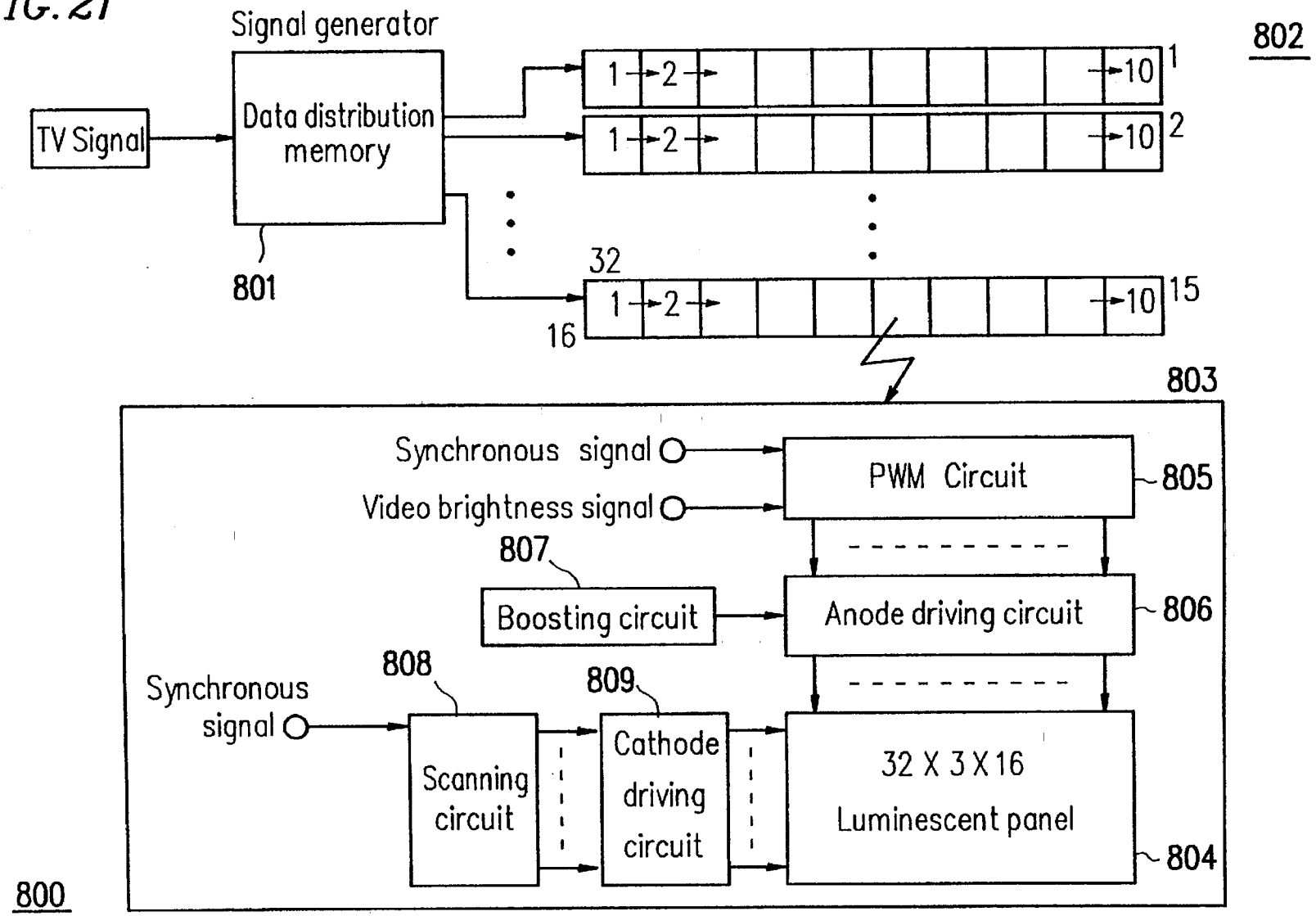
FIG. 21 schematically illustrates a system configuration of a color video display apparatus in accordance with the present invention.

As a seventh example of the invention, there is described a color video display apparatus capable of displaying a large screen provided by arraying many luminescent panels described in the first to third examples in two dimensions. FIG. 21 is a schematic view showing a system configuration of a color video display apparatus 800 of this example of the invention.

In the color video display apparatus 800, a plurality of units 803 respectively including a luminescent panel 804 and its driving system are arranged in the form of matrix 802 of 15×10. Each of the respective luminescent panels 804 in the units 803 may be any one described in the first to third examples of the invention.

When the respective luminescent panels 804 include picture elements arranged in the form of matrix of 16×32 as described in the previous examples and the matrix 802 includes the units 803 of 15×10 as described above, the total of 76,800 picture elements are arranged in the form of matrix of 320×240 in the color video display apparatus 800. However, the size of the matrix 802, the number of the units 803 in the matrix 802, and consequently the number of luminescent panels 804 are not limited to the above-mentioned respective figures.

Although in FIG. 21, the unit 803 is drawn so as to have the driving system 700 of the sixth example having the boosting circuit 807, it may alternatively be either one of the driving systems 500 or 600, having the high-voltage power supply, described in the fourth and fifth examples. In addition, to simplify FIG. 21, the unit 803 is drawn as blocks such as a luminescent panel 804, a PWM circuit 805, an anode driving circuit 806, a boosting circuit 807, a scanning circuit 808 and a cathode driving circuit 809. Since detailed circuit structure of the blocks 804–809 and the description have been described in the first to sixth examples, they are not displayed nor described here again.

A TV signal to be displayed is appropriately distributed to the units 803 in the matrix 802 by a data distribution memory 801. The data distribution memory 801 further appropriately controls an operation of the driving system included in each unit 803 corresponding to the applied TV signal, so that a desired image is properly displayed on the matrix of the picture elements formed by many luminescent panels 804.

In the color video display apparatus 800 according to this example of the invention, by using the improved hot cathode type luminescent panels 804, which are described in the first to third examples, and the driving systems as described in the fourth to sixth examples, the picture element pitch can be narrowed to the order of millimeter, while a high energy efficiency of hot cathode type luminescent elements remains. In addition, a high-quality image with a uniform brightness can be obtained. Furthermore, the external wirings can be simplified, whereas many picture elements are arranged in the form of matrix.

Consequently, according to this example of the invention, there can be provided the color video display apparatus 800, capable of being used both indoors and outdoors and of displaying high-quality images with a uniform brightness.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A luminescent panel for color video display, comprising:

a rear plate on which a plurality of filaments are stretched in a row direction;

an insulating plate provided on the rear plate so as to cover the plurality of filaments, the insulating plate having a plurality of through-holes arranged in a matrix for exposing respective predetermined portions of the plurality of filaments;

a light-transmissive front plate including a plurality of anode lines stretched in a column direction and a rib covering the plurality of anode lines, the rib comprising a plurality of cavities arranged in a matrix for igniting hot cathode discharge between a selected one of the plurality of filaments and a selected one of the plurality of anode lines via a corresponding one of the plurality of through-holes;

a first phosphor means for being excited by the discharge and emitting a first kind of phosphorescence, the first phosphor means provided corresponding to a first line group of the plurality of the anode lines; and a second phosphor means for being excited by the discharge and emitting a second kind of phosphorescence, the second phosphor means provided corresponding to a second line group of the plurality of the anode lines.

2. A luminescent panel according to claim 1, further comprising a third phosphor means for being excited by the discharge and emitting a third kind of phosphorescence, the third phosphor means provided corresponding to a third line group of the plurality of the anode lines.

3. A luminescent panel according to claim 1, wherein each of the plurality of through-holes is further divided corresponding to kinds of the phosphor means.

4. A luminescent panel according to claim 1, further comprising an outer peripheral wall provided along the outer periphery of the luminescent panel.

5. A luminescent panel according to claim 1, wherein respective terminals fixing each of the plurality of filaments are extended onto a side surface of the rear plate, and each of the plurality of anode lines is extended to a side surface of the front plate.

6. A luminescent panel according to claim 1, wherein a mixture gas of mercury vapor and a rare gas is confined in the plurality of cavities with a gas pressure in a range of 2 to 20 Torr, the rare gas being selected from a group consisting of Xe gas and Kr gas.

7. A luminescent panel according to claim 1, wherein each of the plurality of filaments includes a tungsten wire as a core member and an oxide layer provided around the core member, the oxide layer capable of emitting electrons.

8. A luminescent panel according to claim 7, wherein rhenium is further added to the tungsten wire.

9. A luminescent panel according to claim 7, wherein the oxide layer includes a main element selected from a group consisting of barium oxide, strontium oxide and calcium oxide.

10. A luminescent panel according to claim 9, wherein the oxide layer further includes an additive at a concentration of 2 to 10 wt %, the additive being selected from a group consisting of zirconium and zirconium oxide.

11. A luminescent panel according to claim 1, further comprising a driving system for driving the luminescent panel, the driving system comprising:

a plurality of transformers respectively having at least one secondary winding, the at least one secondary winding respectively connected to each of the plurality of filaments;

a plurality of transistors respectively connected to the at least one secondary winding of each of the plurality of transformers;

a scanning circuit for selectively and sequentially switching the plurality of transistors so as to selectively and sequentially scan the plurality of filaments;

a plurality of constant current circuits respectively connected to each of the plurality of anode lines via each of a plurality of first diodes;

a PWM circuit for allowing a discharge current to flow during a horizontal scanning period through each of the plurality of anode lines via a corresponding one of the plurality of constant current circuits and a corresponding one of the plurality of first diodes, the discharge current having a pulse width determined in accordance with a video brightness signal; and a high voltage supplying means for supplying a high voltage pulse to the plurality of anode lines so as to ignite the discharge.

12. A luminescent panel according to claim 11, wherein the high voltage supplying means is a power supply capable of a high voltage.

13. A luminescent panel according to claim 11, the high voltage supplying means comprising:

a boosting circuit;

a plurality of condensers, one terminal thereof respectively connected to each of the plurality of anode lines, the other terminal of the condensers respectively connected to the boosting circuit; and a plurality of gate circuits for compulsorily maintaining the plurality of constant current circuit in an ON state and supplying a charging current to the plurality of condensers during a horizontal blanking period, wherein the boosting circuit outputs a first predetermined voltage at an initial stage of the horizontal blanking period so as to charge the plurality of condensers up to a discharge sustaining voltage, and then outputs a second predetermined voltage so as to ignite the discharge between the selected one of the plurality of filaments and the selected one of the plurality of anode lines at an initial stage of the horizontal scanning period.

14. A luminescent panel according to claim 11, wherein each of the plurality of transistors are respectively connected to a center tap provided in the at least one secondary winding of each of the plurality of transformers.

15. A luminescent panel according to claim 11, further comprising:

a plurality of second diodes, a positive terminal thereof being connected to one end of the at least one secondary winding of each of the plurality of transformers; and a plurality of third diodes, a positive terminal thereof connected to the other end of the at least one secondary winding of each of the plurality of transformers, a negative terminal of the respective third diodes connected to a negative terminal of the respective second diodes, wherein each of the plurality of transistors is connected to each connecting point between the respective second diodes and the respective third diodes.

16. A luminescent panel according to claim 15, further comprising a plurality of resistors for supplying a bias voltage, the resistors respectively connected to one end of the at least one secondary winding of each of the plurality of transformers.

17. A luminescent panel according to claim 11, wherein a plurality of the luminescent panels are arranged in a matrix so as to form a display, further connected to the display are:

a plurality of the driving systems corresponding to each of the plurality of luminescent panels, and control means for distributing a signal of an image to be displayed on the display to the plurality of luminescent panels and driving the plurality of driving systems in accordance with the signal.

18. A luminescent panel for color video display according to claim 1, wherein each of the cavities forms a discharge room for the hot cathode discharge with the light-transmissive front plate and the insulating plate as a lid and a bottom, respectively.

19. A luminescent panel for color video display according to claim 18, wherein each of the cavities forming the discharge room overlaps with one of the through-holes at one end in a longitudinal direction of the cavity, and one of the anode lines is positioned at the other end of the cavity in the longitudinal direction thereof.

20. A luminescent panel for color video display according to claim 19, wherein the discharge room formed by each of the cavities has an elongated-shape.

* * * * *

UNITED STATES PATENT AND TRADE MARK OFFICE

CERTIFICATE OF CORRECTION

PATENT NO. : 5,629,716
DATED : May 13, 1997
INVENTOR(S) : Okamoto et al.

It is certified that error appears in the above-identified patent and that said Letters Patent is hereby corrected as shown below:

On the cover page, item [30] Foreign Application Priority Data, delete "Nov. 21, 1993 [JP] Japan 5-282986" and insert --Nov. 12, 1993 [JP] Japan 5-282986--.

Column 5, line 57, "FIG" should be --FIG. 17--.

Column 7, line 49, "Just" should be --just--.

Column 11, line 56, "Tort" should be --Torr--.

Column 12, line 6, "AS" should be --As--.

Signed and Sealed this

Third Day of March, 1998

Bruce Lehman

*Attest:*

BRUCE LEHMAN

*Attesting Officer*

*Commissioner of Patents and Trademarks*